US010434813B2

(12) United States Patent
Hansen et al.

(10) Patent No.: US 10,434,813 B2
(45) Date of Patent: Oct. 8, 2019

(54) METHOD FOR PRODUCING A DOCUMENT AND A DOCUMENT

(71) Applicants: LEONHARD KURZ Stiftung & Co. KG, Furth (DE); OVD Kinegram AG, Zug (CH); KURZ TYPOFOL GmbH, Dobeln (DE)

(72) Inventors: Achim Hansen, Zug (CH); Kilian Schuller, Furth (DE); Anja Cathomen, Morschach (CH); Sascha Falsch, Dobeln (DE); Philipp Schuler, Morschach (CH)

(73) Assignees: LEONHARD KURZ STIFTUNG & CO. KG, Furth (DE); OVD KINEGRAM AG, Zug (CH); KURZ TYPOFOL GMBH, Furth (DE)

( * ) Notice: Subject to any disclaimer, the term of this patent is extended or adjusted under 35 U.S.C. 154(b) by 0 days.

(21) Appl. No.: 15/564,013

(22) PCT Filed: Apr. 7, 2016

(86) PCT No.: PCT/EP2016/057654
§ 371 (c)(1),
(2) Date: Oct. 3, 2017

(87) PCT Pub. No.: WO2016/162439
PCT Pub. Date: Oct. 13, 2016

(65) Prior Publication Data

US 2018/0134062 A1 May 17, 2018

(30) Foreign Application Priority Data

Apr. 8, 2015 (DE) ..... 10 2015 105 285

(51) Int. Cl.
*B42D 25/405* (2014.01)
*B42D 25/455* (2014.01)
(Continued)

(52) U.S. Cl.
CPC ..... *B42D 25/324* (2014.10); *B41M 3/142* (2013.01); *B41M 5/30* (2013.01); *B42D 25/21* (2014.10);
(Continued)

(58) Field of Classification Search
CPC ..... B42D 25/405; B42D 25/455
See application file for complete search history.

(56) References Cited

U.S. PATENT DOCUMENTS 5,244,234 A * 9/1993 Oshima ..... B42D 25/405 283/109
5,712,673 A 1/1998 Hayashi et al.
(Continued)

FOREIGN PATENT DOCUMENTS

DE 69515928 10/2000
DE 60218158 11/2007
(Continued)

*Primary Examiner* — Kyle R Grabowski
(74) *Attorney, Agent, or Firm* — Hoffmann & Baron, LLP

(57) ABSTRACT

A method for producing a security document, with a thermographic substrate wherein the thermographic substrate is caused to undergo a color change depending on temperature effect in at least one first region A film element is arranged in such a way that the film element is arranged between the at least one first region of the thermographic substrate and a thermal print head. At least one first item of information is introduced by means of the thermal print head by activation of the color change in the at least one first region of the thermographic substrate, wherein the thermal print head, during the introduction of the at least one first item of information is in contact with the film element in such a way that the temperature effect causing the activation of the color change is transferred from the thermal print head through the film element to the at least one first region of the thermographic substrate.

13 Claims, 11 Drawing Sheets

(51) Int. Cl.

| | |
|---|---|
| ***B42D 25/324*** | (2014.01) |
| ***B41M 3/14*** | (2006.01) |
| ***B41M 5/30*** | (2006.01) |
| ***B42D 25/328*** | (2014.01) |
| ***B42D 25/21*** | (2014.01) |
| ***B42D 25/364*** | (2014.01) |
| ***B42D 25/378*** | (2014.01) |
| ***B42D 25/45*** | (2014.01) |
| *B42D 25/342* | (2014.01) |
| *B41M 7/00* | (2006.01) |

(52) U.S. Cl.

CPC ..... *B42D 25/328* (2014.10); *B42D 25/364* (2014.10); *B42D 25/378* (2014.10); *B42D 25/405* (2014.10); *B42D 25/45* (2014.10); *B42D 25/455* (2014.10); *B41M 7/0045* (2013.01); *B41M 2205/38* (2013.01); *B41M 2205/40* (2013.01); *B42D 25/342* (2014.10)

(56) References Cited

U.S. PATENT DOCUMENTS

| | | | | |
|---|---|---|---|---|
| 5,863,859 | A | 1/1999 | Uytterhoeven et al. | |
| 6,264,782 | B1 * | 7/2001 | Oshima | B42D 25/328 283/77 |
| 7,635,660 | B2 | 12/2009 | Bhatt et al. | |
| 7,821,716 | B2 | 10/2010 | Staub et al. | |
| 7,934,752 | B2 * | 5/2011 | Saito | G03H 1/0011 283/72 |
| 8,367,277 | B2 | 2/2013 | Brehm et al. | |
| 8,450,029 | B2 | 5/2013 | Staub et al. | |
| 8,546,301 | B2 | 10/2013 | Ribi et al. | |
| 9,321,294 | B2 | 4/2016 | Scheuer | |
| 9,694,618 | B2 | 7/2017 | Brehm et al. | |
| 2002/0056991 | A1 * | 5/2002 | Tamura | G09F 3/0288 283/114 |
| 2002/0140798 | A1 | 10/2002 | Bhatt et al. | |
| 2015/0018206 | A1 * | 1/2015 | Scheuer | B42D 25/351 503/201 |
| 2015/0042084 | A1 | 2/2015 | Staub et al. | |
| 2016/0332476 | A1 * | 11/2016 | Inokuchi | B42D 25/328 |
| 2017/0197452 | A1 * | 7/2017 | Philippe | B42D 25/455 |

FOREIGN PATENT DOCUMENTS

| | | | |
|---|---|---|---|
| DE | 102006037431 | 4/2008 | |
| DE | 102012001121 | 7/2013 | |
| DE | 102013108666 | 3/2015 | |
| WO | WO0168383 | 9/2001 | |
| WO | WO2006084685 | 8/2006 | |
| WO | WO2006084686 | 8/2006 | |
| WO | WO2011006634 | 1/2011 | |
| WO | WO2013110565 | 8/2013 | |
| WO | WO-2013110565 A1 * | 8/2013 | B42D 25/355 |

* cited by examiner

METHOD FOR PRODUCING A DOCUMENT AND A DOCUMENT

This application claims priority based on an International Application filed under the Patent Cooperation Treaty, PCT/EP2016/057654, filed Apr. 7, 2016, which claims priority to DE102015105285.7, filed Apr. 8, 2015.

BACKGROUND OF THE INVENTION

The invention relates to a method for producing a document, as well as a document.

Documents, in particular tickets or vouchers are predominantly provided locally by vending machines such as for example travel ticket vending machines or cash registers. For this purpose, the tickets, travel tickets or vouchers are provided with individualized items of information such as for example an overprint which indicates the date of issue or date of expiry. In particular, the thermal printing process or the thermal transfer printing process have proved successful for introducing the information.

In the case of the thermal printing process, substrates which already contain a color-generating substance are used. For introducing the printing, a print head with a plurality of heating elements is brought into direct contact with the substrate and the color-generating substance is heat-activated point by point. However, in the case of the thermal printing process, the direct contact of the print head with the substrate is disadvantageous. The print head hereby becomes worn out, in particular through abrasive wear, which in turn results in shortened maintenance intervals and thus reduced service lives. Thus, particles rubbed off through the abrasive wear and further dirt particles which occur increasingly, in particular in the case of travel ticket vending machines directly exposed to weather and environmental influences, shorten the lifetime of the print head.

In the case of the thermal transfer printing process, a transfer ply of a hot-stamping film is transferred to a substrate pixel-wise by means of a print head. It is disadvantageous here that the decoration layer applied hereby to the substrate can for example be largely removed by scraping or by using solvents. The use of the thermal transfer process, in particular for use in value or security documents, such as for example tickets, is hereby greatly restricted as documents printed in this way can be easily manipulated and therefore have little protection against forgery.

SUMMARY OF THE INVENTION

The object of the invention now is to provide a method for producing a document, as well as a document which avoid the disadvantages of the state of the art.

This object is achieved by a method for producing a document, in particular a security document with a thermographic substrate, wherein the method comprises the following steps: a) provision of the thermographic substrate which is caused to undergo a color change in at least one first region depending on the temperature effect; b) arranging a film element in such a way that the film element is arranged between the at least one first region of the thermographic substrate and a thermal print head; c) introducing at least one first item of information by means of the thermal print head by activating the color change in the at least one first region of the thermographic substrate, wherein the thermal print head, during the introduction of the at least one first item of information, is in contact with the film element in such a way that the temperature effect causing the activation of the color change is transferred from the thermal print head through the film element to the at least one first region of the thermographic substrate. This object is further achieved by a document, in particular a security document, with a thermographic substrate, in particular produced according to the method according to one of claims 1 to 12, wherein the thermographic substrate which can be caused to undergo a color change by means of a thermal print head depending on temperature effect, has at least one first item of information in at least one first region, and wherein the at least one first item of information is formed by an activation of the color change in the at least one first region of the thermographic substrate.

The film element can have one or more layers which form a layered composite. It is thus possible that the film element is a film element comprising one or more layers.

It has been shown here that the temperature effect necessary in the thermographic substrate for activating the color change is transferred through the film element to the thermographic substrate in such a way that the color change is activated in the thermographic substrate by the temperature effect. During the transfer of the temperature effect necessary for the activation of the color change onto the thermographic substrate, the thermal print head is not directly in contact with the thermographic substrate here. Rather, the temperature effect necessary for the activation of the color change is transferred through the film element to the thermographic substrate. On the one hand, the thermal print head is hereby not in contact with the document, whereby wear of the thermal print head, in particular through abrasive wear, is reduced. On the other hand, the first item of information is introduced into the thermographic substrate by means of activation of the color change in the first regions. A first item of information introduced into the thermographic substrate in this way cannot be easily removed simply by scraping or by using solvents. Thus, the thermal print head is protected from wear and environmental influences by the film element arranged between the thermographic substrate and the thermal print head when the first item of information is introduced, whereby the maintenance intervals and thus the service life are increased. Furthermore, it is hereby achieved that the thermographic substrate or further layers applied to the thermographic substrate need to have lower requirements, in particular with respect to temperature resistance and sliding capability.

The film element which is arranged between the thermal print head and the thermographic substrate, or between the thermal print head and the further layers applied to the thermographic substrate, makes possible the use of thermographic substrates or thermographic substrates with applied further layers which could not be used in the thermal printing process until now because of their temperature resistance and sliding capability.

By "thermographic substrate" is meant here a substrate which can be locally caused to undergo a color change depending on temperature effect. The thermographic substrate comprises color-producing substances which, under the effect of temperature, in particular under the effect of heat, react chemically and produce the color change. It is thus possible that the thermographic substrate is a thermal paper which has a thermosensitive layer in which pigments, binders, colorformers, developers and auxiliary materials are contained. Leuco dyes which appear colorless in crystalline form or in a pH-neutral environment are preferably used as colorformers. By contrast, in a melt with an acid environment, the leuco dyes appear colored. For example, such leuco dyes can be immobilized in a matrix with an acid.

Heating the matrix above the melting point results in a chemical reaction, such that the leuco dyes now appear colored due to absorption of light from the visible wavelength range. Thus, for example, a white thermographic substrate can appear black in the region activated by the temperature effect. Furthermore, it is also possible that a color change for example from yellow to violet can be caused in the thermographic substrate due to the temperature effect.

By "temperature effect" is here meant the effect of warmth or heat on the thermographic substrate. When the at least one first item of information is introduced, there is firstly a temperature difference between the thermal print head or its heating elements and the thermographic substrate, such that the thermal print head has a higher temperature compared with the thermographic substrate. The warmth here is the energy which is transferred from the location with the high temperature to the location of low temperature. The warmth transport can take place via thermal conduction, thermal radiation or convection. Thus, it is for example possible that thermal energy is transferred by means of thermal conduction. Thus, for example, if the thermal print head has a temperature of 100° C. and the thermographic substrate a temperature of 30° C., there is a temperature effect such that the warmth of the thermal print head acts on the thermographic substrate and activates the color change in the thermographic substrate.

By "color change" is here meant both a change from colorless to colored and a change in color between two different colors. It is thus possible for example that the thermographic substrate is caused by the temperature effect to undergo a color change from colorless to blue. A change in color of the thermographic substrate from red to magenta is also possible, for example, through activation of the color change. By "colored" is here meant any color which can be represented in a color model such as e.g. the RGB color model (R=red; G=green; B=blue) or the CMYK color model (C=cyan; M=magenta; Y=yellow; K=black) as a color dot within a color space. A change in the chromaticity can also bring about a change in contrast for example from white to black or from dark green to light green.

Furthermore, it is possible that in step c), with the side facing away from the thermal print head, the film element is in contact with the document, in particular the security document, and/or the thermographic substrate, such that the temperature effect causing the activation of the color change is transferred from the thermal print head through the film element to the at least one first region of the thermographic substrate.

Further advantageous embodiments of the invention are referred to in the dependent claims.

Preferably, in step c), one or more first layers of the film element are applied to the document, in particular security document, in the at least one first region, by means of the thermal print head.

Furthermore, it is possible that one or more layers of the film element are formed as a carrier layer and one or more first layers of the film element are formed as a transfer ply detachable from the carrier layer wherein, in step c), the transfer ply is applied to the document, in particular security document, in the at least one first region, by means of the thermal print head. The film element is preferably formed as a transfer film, in particular thermal transfer film. It is thus possible that the transfer ply is formed by one or more first layers of the film element.

The document advantageously has one or more first layers in the at least one first region, wherein the one or more first layers are arranged accurately fitting the at least one first item of information in the at least one first region of the thermographic substrate.

It is hereby achieved that the first item of information introduced in the first region of the thermographic substrate and the one or more first layers of the film element applied in the first region, are arranged accurately fitting, i.e. precisely positioned relative to each other. Furthermore, in a single process step, both the color change is produced in the thermographic substrate and the one or more first layers of the film element are applied to the document. The process times and the production costs are hereby reduced. Furthermore, by the one or more first layers applied in the first regions, a protection of the first item of information also introduced in the first regions of the thermographic substrate is also achieved. Through the additionally applied one or more first layers which are applied accurately fitting the first item of information in the thermographic substrate, the item of information introduced into the thermographic substrate is protected for example vis-à-vis environmental influences or solvents which are applied to the thermographic substrate. Thus, the item of information introduced into the thermographic substrate is protected vis-à-vis mechanical and chemical influences. The stability of the item of information introduced into the thermographic substrate is hereby increased. The protection against forgery and the protection vis-à-vis manipulation of the document is also further increased hereby, as the first item of information is provided several times and thus redundantly in the first regions, i.e. both by the one or more first layers of the film element applied to the document, and by the color change introduced into the thermographic substrate. Thus if, for example, the one or more first layers are removed in the first region of the document, the first item of information is thus still recognizable in the first regions in the thermographic substrate. Such manipulations are also easily recognizable as, for example, under one or more colored first layers of the document which are removed by scraping, a thermographic layer which is caused to undergo a black color change is arranged, which appears after the scraping.

Furthermore, it is advantageous if, in at least one second region, the temperature effect causing the activation of the color change is selected such that, in the at least one second region, the at least one first item of information is not introduced into the thermographic substrate and the one or more first layers of the film element are applied to the document, in particular security document, by means of the thermal print head, for the representation of at least one second item of information.

The document advantageously has one or more first layers in at least one second region, for the representation of at least one second item of information, wherein the thermographic substrate does not have the at least one first item of information in the at least one second region.

Here, in the first region, both the color change is activated in the thermographic substrate and the one or more first layers of the film element are applied to the document. In the second region, only the one or more first layers of the film element are applied to the document. The document thus has regions that represent an item of information, which are formed only by the one or more first layers of the film element. Thus, for example, items of information which have less relevance can be applied in the second region by means of the one or more first layers of the film element, and items of information which have high relevance, such as for example an expiry date, can be applied in the first region by means of the one or more first layers of the film element and, furthermore, be introduced by the color change in the thermographic substrate.

Furthermore, it is possible that the at least one first region and the at least one second region lie in the maximum recording range of the thermal print head, wherein the maximum recording range corresponds to the maximum area of the thermal print head with which the thermal print head is in contact with the film element during the introduction of the first item of information in step c). The at least one first region and the at least one second region are thus partial regions of the maximum recording range of the thermal print head. It is thus possible that the at least one first item of information in the at least one first region and the at least one second item of information in the at least one second region are substantially produced simultaneously. The thermal print head preferably has different temperatures in the at least one first region and in the at least one second region, in particular such that the at least one first item of information is introduced in the at least one first region and the one or more first layers of the film element are applied to the document, in particular security document, by means of the thermal print head, and that the at least one first item of information is not introduced in the at least one second region and the one or more first layers of the film element are applied to the document, in particular security document, by means of the thermal print head, for the representation of the at least one second item of information.

By the term "recording range" is here meant a defined area, which corresponds to the maximum area of the thermal print head by means of which the color change can be brought about in the thermographic substrate by temperature effect, and with which the thermal print head is in contact with the film element during the introduction of the first item of information in step c). It is thus possible, for example, to cause the color change throughout the entire recording range. Furthermore, it is also possible to cause the color change only in one or more regions, in particular in the first region of the recording range.

Furthermore, it is advantageous that the at least one first region and/or the at least one second region is formed patterned, in particular in the form of lettering. A pattern can, for example, be a graphically formed outline, a figural representation, an image, a motif, a symbol, a logo, a portrait, an alphanumeric character, a text and the like.

Furthermore, it is possible that the one or more first layers of the film element are transparent in the at least one first region and not transparent in the at least one second region. The first item of information hereby appears in the first region in the color which is caused by the activation of the color change of the thermographic substrate and the second item of information is recognizable in the second region by means of the non-transparent one or more first layers of the film element.

The resolution of the at least one first item of information in the at least one first region and/or the resolution of the at least one second item of information in the at least one second region is preferably more than 200 dpi, preferably more than 300 dpi, further preferably more than 600 dpi.

Furthermore, it is possible that the resolution is different in the X and Y directions. In the direction of travel the paper, this is determined in particular by the paper feed of the printer. Transversely to the direction of travel of the paper, this is determined by the size of and distance between the heating elements of the print head.

Furthermore, it is possible that the thermographic substrate provided in step a) is caused to undergo at least two color changes in at least two first regions depending on the temperature effect, wherein the at least two color changes are caused when at least two different temperature limits are exceeded. The protection against forgery of the document can be further increased hereby.

Furthermore, it is possible that the at least two different temperature limits differ by more than 5° C., preferably more than 10° C., further preferably by more than 15° C.

Depending on the design of the one or more first layers in the at least one first region and/or in the at least one second region of the document, the optical impression of the document can be changed and the protection against forgery further increased. The one or more first layers of the film element in the at least one first region and/or the at least one second region are preferably applied to the document, in particular security document, by means of the thermal print head, in such a way that the produced document, in particular security document, comprises the one or more first layers. Possibilities for the design of the one or more first layers of the film element are described below.

The one or more first layers of the film element preferably comprise an adhesive layer.

The adhesive layer preferably has a layer thickness between 0.1 μm and 10 μm, preferably between 0.5 μm and 5 μm, further preferably between 0.8 μm and 3 μm.

The application weight of the adhesive layer is preferably 1 $g/m^2$ to 4 $g/m^2$, preferably 1.5 $g/m^2$ to 3 $g/m^2$. Here and in the following, an application weight of approximately 1 $g/m^2$ corresponds to a resulting layer thickness of the dry layer of approximately 1 μm.

It is advantageous that the adhesive layer comprises acrylates, PVC (=polyvinyl chloride), PUR (=polyurethane) or polyester.

Furthermore, it is advantageous that at least one layer of the one or more first layers has color pigments and/or dissolved dyes.

The at least one layer having the color pigments and/or dissolved dyes preferably has a layer thickness between 0.1 μm and 10 μm, preferably between 0.3 μm and 3 μm, further preferably between 0.5 μm and 2 μm.

The application weight of the at least one layer having the color pigments and/or dissolved dyes is preferably 1 $g/m^2$ to 3 $g/m^2$, preferably 1.5 $g/m^2$ to 2.5 $g/m^2$.

The at least one layer having the color pigments and/or dissolved dyes preferably comprises PMMA (=polymethyl methacrylate), PVC, silicon dioxide, PPF (=polydialkylphosphate), polyester resin, maleic resin or formaldehyde resin.

It is possible that the at least one layer having the color pigments and/or dissolved dyes is present in at least one first partial region of the at least one first region and/or of the at least one second region and is not present in at least one second partial region of the at least one first region and/or of the at least one second region.

Furthermore, it is possible that the at least one first partial region and/or the at least one second partial region is formed patterned. A pattern can, for example, be a graphically formed outline, a figural representation, an image, a motif, a symbol, a logo, a portrait, an alphanumeric character, a text and the like.

The at least one layer having the color pigments and/or dissolved dyes is advantageously transparent, semi-transparent or translucent.

The at least one layer having the color pigments and/or dissolved dyes preferably has different color pigments and/or dissolved dyes in at least two third partial regions of the at least one first region and/or of the at least one second region, wherein the different color pigments and/or dissolved dyes in the at least two third partial regions correspond to different colors, in particular of the RGB color space.

It is advantageous if the at least two third partial regions are formed patterned. A pattern can, for example, be a graphically formed outline, a figural representation, an image, a motif, a symbol, a logo, a portrait, an alphanumeric character, a text and the like.

It is also possible that the at least two third partial regions are arranged according to a grid.

A first color is advantageously produced in step c) by color change of the thermographic substrate in the at least one first region, and the one or more first layers of the film element which are applied to the document, in particular security document, in the at least one first region in step c), are formed colored in a second color at least in regions, wherein the first color and the second color are different colors, in particular of the RGB color space.

Furthermore, it is advantageous if the film element arranged in step b) has one or more dyes and/or one or more adhesives, and in step c) the one or more dyes and/or the one or more adhesives are melted on during application.

According to a further preferred embodiment example, the one or more first layers of the film element comprise a transparent protective varnish layer. It is advantageous if the transparent protective varnish layer comprises PMMA, PVC, acrylate or carnauba wax.

The transparent protective varnish layer preferably has a layer thickness between 0.1 μm and 10 μm, preferably between 0.3 μm and 1 μm, further preferably between 0.5 μm and 1 μm.

The application weight of the transparent protective varnish layer is preferably 0.1 $g/m^2$ to 1 $g/m^2$, preferably 0.3 $g/m^2$ to 0.6 $g/m^2$, further preferably 0.35 $g/m^2$ to 0.5 $g/m^2$.

The one or more first layers of the film element preferably comprise a replication varnish layer. It is advantageous if the replication varnish layer comprises PMMA or styrene copolymer.

The replication varnish layer preferably has a layer thickness between 0.1 μm and 10 μm, preferably between 0.3 μm and 3 μm, further preferably between 0.5 μm and 2 μm.

The application weight of the replication varnish layer is preferably 0.1 $g/m^2$ to 2.5 $g/m^2$, preferably 0.15 $g/m^2$ to 2 $g/m^2$, further preferably 0.2 $g/m^2$ to 1.5 $g/m^2$.

According to a further preferred embodiment example, the film element arranged in step b) has a replication varnish layer, a detachment layer and a transparent protective varnish layer, wherein a relief structure is molded into the replication varnish layer at least in regions, and wherein the detachment layer is arranged between the replication varnish layer and the transparent protective layer, and wherein the replication varnish layer is facing the thermal print head, and in step c) the transparent protective varnish layer is applied to the document, in particular security document, by means of the thermal print head in such a way that a relief structure that is inverted with respect to the relief structure of the replication varnish layer is molded into the transparent protective varnish layer. It is hereby achieved that the negative form of the relief structure molded into the replication varnish layer in step b) is molded onto the transparent protective varnish layer and this transparent protective varnish layer has the relief structure on its free upper side on the document.

The detachment layer is preferably formed as a wax layer. The application weight of the wax layer is preferably 0.005 $g/m^2$ to 0.1 $g/m^2$, preferably 0.0075 $g/m^2$ to 0.05 $g/m^2$. The detachment layer can alternatively also consist of a strongly filming acrylate and/or also be part of the protective varnish layer and have a layer thickness of from 1 μm to 5 μm, preferably 1 μm to 3 μm.

Furthermore, it is possible that the replication varnish layer is formed by a UV-cross-linkable varnish and the relief structure is molded into the replication varnish layer by means of UV replication. The relief structure is molded onto the uncured replication varnish layer by the action of a stamping tool and the replication varnish layer is cured before and/or directly during and/or after the molding by irradiation with UV light.

Furthermore, it is possible that the replication varnish layer and/or the transparent protective varnish layer is stained It is thus possible that the replication varnish layer and/or the transparent protective varnish layer have color pigments and/or dissolved dyes.

It is advantageous that a relief structure is molded into the surface of the replication varnish layer and/or into the surface of the transparent protective varnish layer at least in regions, in particular a diffractive relief structure selected from the group Kinegram® or hologram, zero-order diffraction structure, blazed grating, in particular asymmetrical saw-tooth relief structure, diffraction structure, in particular linear sinusoidal diffraction grating, or crossed sinusoidal diffraction grating or linear single- or multi-step rectangular grating, or crossed single- or multi-step rectangular grating, light-diffracting and/or light-refracting and/or light-focusing micro- or nanostructure, binary or continuous Fresnel lens, binary or continuous Fresnel freeform surface, diffractive or refractive macrostructure, in particular lens structure or microprism structure, mirror surface, mat structure, in particular anisotropic or isotropic mat structure, or combinations of these structures.

The one or more first layers of the film element preferably comprise a reflective layer, in particular a metal layer and/or an HRI or LRI layer (HRI—high refraction index, LRI—low refraction index). Furthermore, it is possible that the reflective layer has a multilayer system made of several reflective layers arranged next to each other and/or over each other, for example metal layers and/or HRI layers or alternating HRI and LRI layers.

It is also possible that the reflective layer is formed as a metal layer made of chromium, aluminum, gold, copper, silver or an alloy of such metals. The metal layer is preferably vapor-deposited in a vacuum in a layer thickness of from 10 nm to 150 nm.

Furthermore, it is also possible that the reflective layer is formed by a transparent reflective layer, preferably a thin or finely-structured metallic layer or a dielectric HRI or LRI layer. Such a dielectric reflective layer consists, for example, of a vapor-deposited layer made of a metal oxide, metal sulfide, e.g. titanium oxide or ZnS etc. with a thickness of from 25 nm to 500 nm.

The reflective layer can be structured by means of known processes, in particular removed in regions. For example, this can take place by means of known etching processes and/or washing processes or also by means of structuring processes as are described for example in WO 2006084685 A2, WO 2006084686 A2, WO 2011006634 A2 or DE 102013108666 A1.

It is possible that the one or more first layers of the film element comprise one or more primer layers. The interlayer adhesion between those layers between which the primer layer is arranged in each case can hereby be set in a targeted manner and thereby improved.

A primer layer of the one or more primer layers is advantageously arranged between the adhesive layer and the reflective layer.

The one or more primer layers preferably have a layer thickness between 0.01 μm and 2 μm, preferably between 0.05 μm and 1 μm, further preferably between 0.1 μm and 0.6 μm.

According to a further preferred embodiment example, at least one layer of the one or more first layers of the film element has pigments which, in the case of irradiation with electromagnetic radiation, preferably in the case of irradiation with UV light, further preferably in the case of irradiation with IR light (UV=ultraviolet; IR=infrared), emit light from the range of the wavelength range visible to the human eye, in particular in the wavelength range from 380 nm to 780 nm. The protection against forgery of the document is hereby further improved, as such a layer can be imitated only with difficulty.

The application weight of the layer having pigments which, in the case of irradiation with electromagnetic radiation, emit light from the range of the wavelength range visible to the human eye, is preferably 0.5 $g/m^2$ to 2 $g/m^2$, preferably 0.75 $g/m^2$ to 1.5 $g/m^2$.

At least one layer of the one or more first layers of the film element preferably has optically variable pigments and/or at least one layer of the one or more first layers of the film element has a thin film layer system which has one or more space layers, the layer thickness of which is selected so that the thin film layer system, by means of interference of the incident light, generates a color shift effect dependent on the observation angle, in particular out of the range of the wavelength range visible to the human eye. Such a thin film layer system is characterized in particular by one or more space layers. The optically effective layer thickness of these space layers, preferably for a specific viewing angle, fulfils the $\lambda/2$- or $\lambda/4$ condition for a wavelength A in particular in the range of visible light. The thin film layer system can here consist of a single layer, of a layer system with one or more dielectric layers and one or more metallic layers or of a layer stack with two or more dielectric layers.

By "optically variable pigments" is here meant in particular pigments which produce a color effect that is dependent on the observation angle, in particular due to interference effects. In order to produce such a color-change effect with a high degree of brilliance, the pigments should have a similar orientation to each other. Such pigments are for example optically variable pigments (OVPs). Furthermore, the at least one layer of the one or more first layers with the optically variable pigments preferably has a binder. Such combinations of binders and pigments are for example optically variable inks (OVI®) which produce an optically variable color impression, in particular due to interference effects. OVIs typically have to be printed in significant layer thicknesses in order to produce a recognizable color-change effect with a high degree of brilliance.

By the term "observation angle" is meant here both the observation angle at which the document is viewed by an observer and also the angle at which the document is illuminated by an illumination device. By "observation angle" is meant the angle formed between the surface normal of the plane spanned by the upper side of the document and the observation direction of an observer. Likewise, by "observation angle" is meant the angle formed between the surface normal of the plane spanned by the upper side of the document and the illumination direction of an illumination device. Thus, for example, at the observation angle of 0° an observer views the surface of the document perpendicularly, and at a viewing angle of 70° an observer views the document at a shallow angle. If the observation direction of the observer or the illumination direction of the illumination device changes, the observation angle consequently changes.

The application weight of the at least one layer having the optically variable pigments and/or the layer having the thin film layer system is preferably 0.5 $g/m^2$ to 20 $g/m^2$, preferably 1.0 $g/m^2$ to 10 $g/m^2$.

Furthermore, it is possible that the reflective layer and/or the layer having the pigments and/or the layer having the optically variable pigments and/or the layer having the thin film layer system is present in at least one fourth partial region of the at least one first region and/or of the at least one second region and is not present in at least one fifth partial region of the at least one first region and/or of the at least one second region. It is hereby made possible, for example, that the color change in the thermographic substrate is recognizable to an observer in the at least one fifth partial region of the at least one first region.

The at least one fourth partial region and/or the at least one fifth partial region is advantageously formed patterned. A pattern can, for example, be a graphically formed outline, a figural representation, an image, a motif, a symbol, a logo, a portrait, an alphanumeric character, a text and the like.

It is possible that the at least one fourth partial region and the at least one fifth partial region are arranged according to a grid.

Furthermore, it is possible that the grid widths are greater than the resolution limit of the naked human eye, in particular that the grid widths are greater than 300 μm. It is hereby achieved that the color change in the thermographic substrate in the at least one first region is recognizable to an observer.

Furthermore, it is also possible that the grid widths are smaller than the resolution limit of the naked human eye, in particular that the grid widths are smaller than 300 μm.

The grid is preferably a one-dimensional and/or two-dimensional grid.

Furthermore, it is advantageous that the grid is a periodic and/or non-periodic grid.

The grid can advantageously be formed such that, in particular when a correspondingly gridded test element is overlaid, a Moiré effect is produced. However, several correspondingly gridded layers can also be provided in the film element and/or on the substrate for the production of such a Moiré effect. It is also possible that the one grid is arranged in one layer, in particular one of the one or more first layers, of the film element and the other grid is formed by the color change in the thermographic substrate.

Furthermore, it is advantageous that the one or more first layers are transparent, semi-transparent or translucent. It is hereby possible, for example, that the color change in the thermographic substrate is recognizable to an observer through the one or more first layers of the film element. It is hereby also possible to produce mixed colors for example according to the RGB color model, by superimposition of the color of the one or more first layers of the film element and the color of the color change in the thermographic substrate.

According to a further preferred embodiment example a layer of the film element arranged facing the thermographic substrate in step b), is formed in such a way that adhesion to the thermographic substrate and/or the document is prevented, and/or a layer of the film element arranged facing the thermal print head in step b) is formed in such a way that a sufficient hot smear resistance is achieved. Through such a design of the film element, it is achieved that a thermal transfer printer can be used for activating the color change in the thermographic substrate of the document, as no layers of the film element are applied to the document. The temperature effect causing the activation of the color change is, however, transferred from the thermal print head through the film element to the thermographic substrate.

It is thus possible that the method is carried out by means of a thermal transfer printer. It is hereby possible to introduce the at least one first item of information into the thermographic substrate of the document by means of a thermal transfer printer. Furthermore, as explained, it is possible to apply one or more first layers to the document in the same process step. Carrying out the method by means of a thermal transfer printer thus makes further cost advantages possible.

The temperature effect in step c) is preferably more than 50° C., preferably more than 55° C., further preferably more than 60° C., still further preferably more than 90° C. Furthermore, it is possible that the temperature effect in step c) is between 50° C. and 200° C., preferably between 55° C. and 175° C., further preferably between 60° C. and 150° C. No hard upper limits are set for the temperature effect for activating thermal papers. The practical limit is currently set by the performance of the thermal print head and the reduced need for higher temperatures.

In step c) the thermal print head advantageously has a temperature of more than 70° C., preferably more than 75° C., further preferably more than 80° C., still further preferably more than 100° C., at least in regions. It is also possible that, in step c) the thermal print head, at least in regions, has a temperature between 70° C. and 220° C., preferably between 75° C. and 210° C., further preferably between 80° C. and 200° C., still further preferably between 90° C. and 195° C.

Furthermore, it is advantageous that the thermographic substrate provided in step a), at least in regions, has one or more second layers that are transparent at least in regions, wherein the one or more second layers are arranged between the film element and the thermographic substrate, when observed perpendicularly to the plane spanned by the upper side of the thermographic substrate, and that in step c), the temperature effect causing the activation of the color change is transferred through the one or more second layers to the at least one first region of the thermographic substrate.

The document, in particular the security document, at least in regions, preferably has one or more second layers that are transparent at least in regions, wherein the one or more second layers cover the at least one first item of information introduced into the at least one first region of the thermographic substrate at least in regions, when observed perpendicularly to the plane spanned by the upper side of the thermographic substrate.

The one or more second layers are advantageously arranged between the thermographic substrate and the one or more first layers of the film element, when observed perpendicularly to the plane spanned by the upper side of the thermographic substrate.

Furthermore, it is possible that the one or more second layers have a decorative layer with at least one optical security feature, in particular an optical security feature recognizable in incident light, which is arranged in a transparent and/or opaque fourth region of the one or more second layers.

The decorative layer advantageously has one or more layers providing the security feature, which contain one or more elements selected from the group: a security print, a UV or IR print, a microprint, a layer containing optically variable pigments, a refractive element, a diffractive element, an anisotropic mat structure, a relief hologram, a volume hologram, a zero-order diffraction structure, a thin film layer effect generating a color shift effect dependent on the viewing angle and/or a cross-linked liquid crystal layer.

In step c), the parameters temperature and time are preferably selected such that the temperature effect causing the activation of the color change is transferred from the thermal print head through the film element to the at least one first region of the thermographic substrate. The parameter time is predominantly determined by the material properties and the mass ratios of the film element arranged in step b), the temperature effect by means of the thermal print head and/or the temperature of the document. Furthermore, it is possible that the parameters temperature and time are also determined by the one or more second layers having the thermographic substrate at least in regions, which are arranged between the thermographic substrate and the film element.

According to a further preferred embodiment example of the invention the document, in particular the security document, on the side of the thermographic substrate facing away from the one or more first layers of the film element and/or the side of the thermographic substrate facing away from the one or more second layers has one or more third layers in at least one fifth region.

The one or more third layers are advantageously optically invariable layers, in particular printed color layers.

Furthermore, it is possible that the one or more third layers have pigments which, in the case of irradiation with electromagnetic radiation, preferably in the case of irradiation with UV and/or IR light, emit light from the range of the wavelength range visible to the human eye, in particular in the wavelength range from 380 nm to 780 nm.

According to a further preferred embodiment example of the invention, the document, in particular the security document, comprises at least one sealing layer.

It is thus possible that the method further comprises the following steps which are carried out, in particular after step c): d) application of at least one sealing layer to the document, in particular the security document.

The at least one sealing layer is preferably a transparent, in particular a transparent and clear layer.

Furthermore, it is advantageous if, in step d), the at least one sealing layer is applied by means of lamination, in particular by means of cold lamination.

The at least one sealing layer is advantageously a protective film, in particular a self-supporting protective film. It is thus also possible that the method further comprises a step of providing at least one sealing layer, in particular at least one protective film, which is carried out in particular between steps c) and d).

Furthermore, it is possible that the at least one protective film forms a pouch. A pouch is a pocket or bag formed by the protective film, into which the document, in particular the security document is inserted, in particular after step c). It is here possible that such a pouch is closed on one, two or three sides, wherein the unclosed three, two or one sides serve for inserting the document, in particular the security document.

Furthermore, it is advantageous if the document, in particular the security document, is laminated with the at least one protective film. It is also possible that the document, in particular security document, is laminated in between a first protective film and a second protective film, in particular when observed perpendicularly to the plane spanned by the upper side of the thermographic substrate. It is thus possible that the document, in particular security document, is laminated on one or both sides with a first protective film and/or a second protective film. Furthermore, it is also possible that the document, in particular security document, after insertion into the pouch formed from the protective film, is laminated into the pouch. It is advantageous here, that the lamination temperature lies below the activation temperature of the thermal paper.

The document, in particular the security element, is hereby protected from environmental influences, such as vis-à-vis mechanical stress, chemical influences (for example against plasticizers) or humidity. It is thus possible that a document, in particular security document, advantageously after introduction of the at least one first item of information after step c), is arranged between two protective films and is laminated with the two protective films, with the result that the document, in particular security document, is hereby protected vis-à-vis environmental influences.

It is advantageous if the at least one protective film comprises PET, PETG, BOPP (=biaxially oriented polypropylene) or PP (=polypropylene). The at least one protective film preferably has a layer thickness between 20 μm and 300 μm, preferably between 30 μm and 250 μm.

Furthermore, it is advantageous if the at least one protective film comprises an adhesive layer. It is thus possible, for example, that each of the two protective films between which the document, in particular security document, is arranged, has an adhesive layer in each case. The adhesive layer preferably has an activation temperature of less than 80° C., preferably of less than 60° C.

Furthermore, it is possible that the adhesive layer is a cold adhesive layer. The activation temperature of the cold adhesive layer advantageously lies at room temperature, preferably between 15° C. and 30° C., further preferably between 19° C. and 25° C., still further preferably between 20° C. and 24° C.

The adhesive layer preferably has color pigments and/or dyes and/or UV absorbers. It is thus possible that the adhesive layer is stained by means of the dyes.

The adhesive layer is preferably a transparent, in particular a transparent and clear, adhesive layer.

It is also possible that the at least one sealing layer is a protective varnish layer.

In step d) the at least one protective varnish layer is preferably applied by means of printing, casting or spraying onto the document, in particular the security document.

The layer thickness of the at least one protective varnish layer is preferably between 0.1 μm and 100 μm, further preferably between 1 and 50 μm.

At least one protective varnish layer is advantageously a layer curable by means of UV light. A layer curable by means of UV light preferably comprises acrylates, polyester acrylates, polyurethane and/or polyurethane acrylates. Furthermore, it is possible that a layer curable by means of UV light has solvents. The curing of such layers preferably takes place by drying, in particular by evaporation of solvents and/or by irradiation by means of UV light.

Furthermore, it is possible that the at least one protective varnish layer is a water-based layer. A water-based protective varnish layer preferably comprises starch derivatives, methyl cellulose and/or polyvinyl alcohol with inorganic additives. The curing of such layers preferably takes place by drying, in particular by evaporation of the water content and/or by curing through esterification.

Furthermore, it is also possible that the at least one protective varnish layer is a solvent-based layer. A solvent-based protective varnish layer preferably comprises acrylates and/or polyurethane. The curing of such layers preferably takes place by drying, in particular by evaporation of the solvent, and/or by an isocyanate reaction, in particular using an isocyanate-based cross-linker.

It is also possible that the at least one protective varnish layer comprises reaction resins, in particular based on epoxy resin. The curing of such layers preferably takes place by drying, in particular by evaporation of the solvent, and/or by chemical cross-linking by polyaddition.

The temperature in the case of curing through drying, in particular in the case of evaporation of water and/or solvents, is preferably less than 80° C., preferably less than 60° C., further preferably less than 40° C.

It is also advantageous if the at least one sealing layer, in particular the at least one protective film and/or adhesive layer and/or protective varnish layer, has pigments, in particular UV light-filtering or -absorbing pigments. It is thus possible that the at least one sealing layer, in particular the at least one protective film and/or adhesive layer and/or protective varnish layer, is formed such that it filters or absorbs UV light, in particular light in the wavelength range between 100 nm and 380 nm, preferably between 200 nm and 380 nm, further preferably between 280 nm and 380 nm. The further layers of the document, in particular the security document, which are arranged under or between the at least one protective film and/or adhesive layer and/or protective varnish layer, when observed perpendicularly to the plane spanned by the upper side of the thermographic substrate, are hereby protected from UV light.

The pigments, in particular the UV light-filtering or -absorbing pigments preferably have titanium oxide and/or zinc oxide. The concentration of such pigments in the at least one sealing layer, in particular in the at least one protective film and/or adhesive layer and/or protective varnish layer, is preferably between 0.1 percent by weight and 15 percent by weight, preferably between 0.2 percent by weight and 10 percent by weight, further preferably between 0.5 and 5 percent by weight.

Furthermore, it is possible that the pigments, in particular the UV light-filtering or -absorbing pigments, have triazines, benzotriazoles, benzophenones, oxalanilides, and/or piperidines. The concentration of such pigments in the at least one sealing layer, in particular in the at least one protective film and/or adhesive layer and/or protective varnish layer, is preferably between 0.01 percent by weight and 10 percent by weight, preferably between 0.1 percent by weight and 5 percent by weight.

The document, in particular the security document, is preferably a ticket, a voucher, a travel ticket, a label, a till receipt, a price tag, a timetable, an account statement, a medical and/or technical graph paper, a lottery ticket, a fax paper or an ID document.

BRIEF DESCRIPTION OF THE DRAWINGS

Embodiment examples of the invention are explained below by way of example with the aid of the accompanying figures which are not drawn to scale.

DETAILED DESCRIPTION OF THE PREFERRED EMBODIMENTS

Figure 1A:
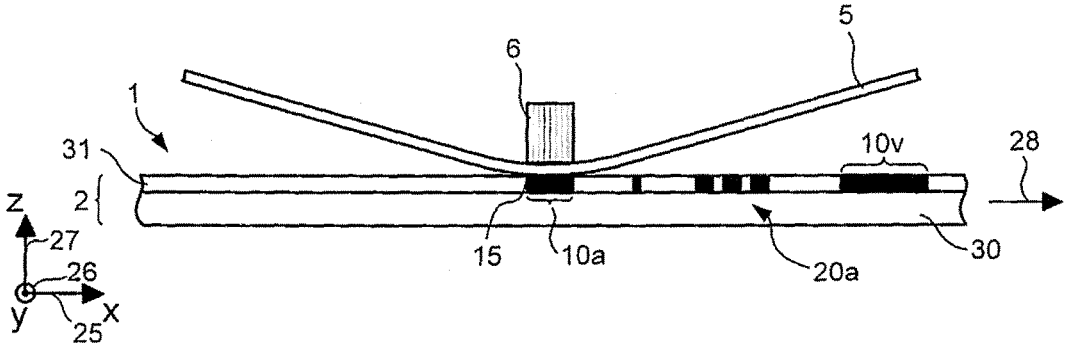
FIG. 1*a* schematically shows a method step for producing a document

FIG. 1*a* shows a method step for producing a document 1. For this purpose, as shown in FIG. 1*a*, a document 1 is provided with a thermographic substrate 2, which can be locally caused to undergo a color change 15 depending on temperature effect. Furthermore, a film element 5 is arranged between a thermal print head 6 which produces the temperature effect, and the thermographic substrate 2. It is possible that the film element 5 comprises one or more layers. The thermal print head 6 has a plurality of heating elements not shown in more detail.

Figure 1B:
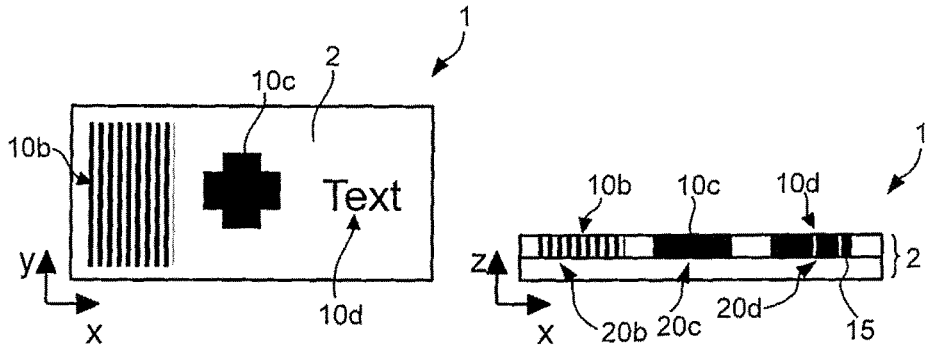
FIG. 1*b* and FIG. 1*c* show schematic top views and sectional representations of design variants of a document FIG. 2*a* schematically shows a method step for producing a document

The upper side of the thermographic substrate 2 spans a plane which, as shown in FIG. 1*b*, is parallel to a plane spanned by the x-coordinate axis 25 and the y-coordinate axis 26. As shown in FIG. 1*a*, the z-coordinate axis 27 is perpendicular to this plane and thus perpendicular to the plane spanned by the upper side of the thermographic substrate 2.

The thermographic substrate 2 comprises a thermosensitive layer 31 and a base layer 30. In FIG. 1*a*, the thermosensitive layer 31 and the base layer 30 are two layers separated from each other. Furthermore, it is also possible that a thermosensitive coating applied to the base layer 30 extends into the volume of the base layer 30, at least in regions.

The base layer 30 is preferably a paper layer, in particular with a layer thickness between 35 μm and 400 μm. The layer thickness of the base layer 30 in FIG. 1*a* is 125 μm. The base layer further preferably has a weight per unit area of 35 g/m$^2$ to 400 g/m$^2$, oven-dry. Furthermore, it is also possible that the base layer 30 consists of one or more paper and/or plastic layers and in particular of a succession of paper and plastic layers.

The thermosensitive layer 31 preferably comprises color-producing substances which, under the effect of warmth, react chemically and activate the color change 15. The thermosensitive layer 31 preferably has pigments, binders, colorformers, developers and auxiliary materials. Leuco dyes which appear colorless in crystalline form or in a pH-neutral environment are preferably used as colorformers. In a melt with an acid environment, the leuco dyes appear colored because of the opened lactone ring. For example, such leuco dyes can be immobilized in a matrix with an acid. Heating the matrix above the melting point results in a chemical reaction, such that the leuco dyes now appear colored due to absorption of light from the visible wavelength range. Phenols such as Bisphenol A (BPA) or Bisphenol S (BPS) can be used as developers for example. Further examples of colorformers are triarylmethane-based dyes, diphenylmethane-based dyes, spiro-based dyes and fluorane-based dyes. Furthermore, the developers can be selected from organic or inorganic development materials. Examples of inorganic development materials are activated clay, attapulgite, colloidal silica, aluminum silicate and the like. Examples of organic development materials are phenolic compounds, salts of phenolic compounds or aromatic carboxylic acids and the like with polyvalent metals such as e.g. zinc, magnesium, aluminum, calcium, titanium, manganese, tin, nickel and the like and/or pyridine complexes of zinc thiocyanates.

After drying, the thermosensitive layer 31 preferably has an application weight of from 1 g/m$^2$ to 10 g/m$^2$, oven-dry, preferably 2 g/m$^2$ to 7 g/m$^2$, oven-dry. As shown in FIG. 1*a*, under the effect of warmth, the color-producing substances in the thermosensitive layer 31 activate a color change 15 from colorless to black in the region 10*a*. Furthermore, it is also possible that a color change between two different colors is activated, for example from yellow to violet. Thus, in addition to the color change 15 from colorless to black, shown in FIG. 1*a*, a color change from colorless to colored, a color change between two different colors or a change in contrast, for example from dark green to light green is possible.

To activate the color change 15 in the region 10*a*, as shown in FIG. 1*a*, the thermal print head 6 is in contact with the film element 5, in such a way that the temperature effect causing the activation of the color change 15 is transferred from the thermal print head 6 through the film element 5 to the region 10*a* of the thermographic substrate. The thermal energy generated by the thermal print head 6 is transmitted through the film element 5, so that the thermosensitive layer 31 is activated in the region 10*a* and prompted to undergo the color change 15. The color change 15 activated in the region 10*a* represents an item of information. Furthermore, it is possible that several regions in which a color change has been activated, represent an item of information. As shown in FIG. 1*a*, the thermographic substrate 2 is moved along a feed direction 28 in the direction of the x axis in such a way that regions in which a color change 15 has been activated, represent the item of information 20*a*. Furthermore, it is also possible that the thermal print head 6 is moved with respect to the thermographic substrate 2 to introduce the item of information 20*a* into the thermographic substrate 2. In the case shown, the thermal print head 6 would be moved with respect to the thermographic substrate 2 against the feed direction 28.

The film element 5 is advantageously in contact with the document 1 and/or the thermographic substrate 2 with the side facing away from the thermal print head 6 in such a way that the temperature effect causing the activation of the color change 15 is transferred from the thermal print head 6 through the film element 5 to the region 10*a* of the thermographic substrate 2.

The thermal print head 6 preferably has a field with a plurality of heating elements such as for example heating resistors. The resolution of the item of information introduced by means of the thermal print head is advantageously more than 150 dpi, preferably more than 300 dpi, further preferably more than 600 dpi. The maximum width of the thermal print head 6, with which the thermal print head is in contact with the film element 5 during the introduction of the item of information is preferably at least 5 mm, preferably at least 10 mm, further preferably at least 50 mm, still further preferably at least 100 mm.

In FIG. 1*a*, during the activation of the color change 15, the thermal print head 6 has a temperature between 70° C.

and 220° C. and the temperature effect indicated hereby in the region 10*a* of the thermographic substrate 2 is between 50° C. and 200° C.

Depending on the feed of the thermographic substrate 2 in the direction of the feed direction 28 and/or activation of the heating elements of the thermal print head 6, it is possible to vary the color change 15 in size and shape. Thus, for example, the region 10*v* has a greater extent than the region 10*a* in the direction of the x-axis.

Figure 1C:
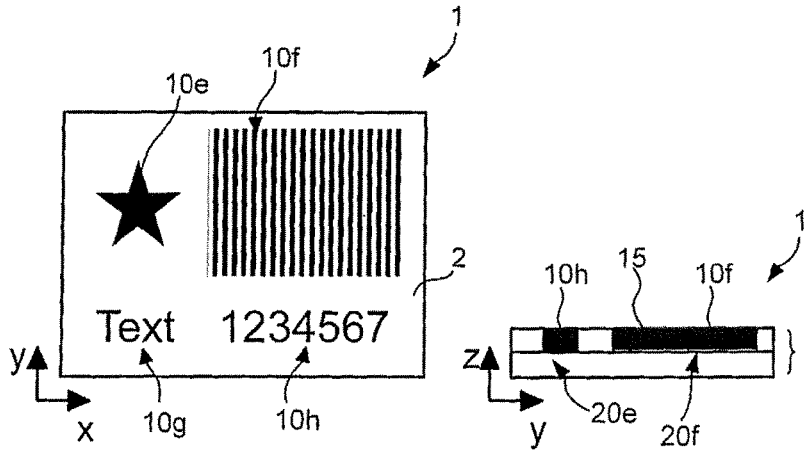

FIG. 1*b* and FIG. 1*c* show schematic top views and sectional representations of design variants of a document 1.

Thus, FIG. 1*b* shows a document 1 with a thermographic substrate 2, wherein the document 1 has the item of information 20*b* in the region 10*b*, the item of information 20*c* in the region 10*c* and the item of information 20*d* in the region 10*d*. The items of information 20*b*, 20*c* and 20*d* are each introduced into the thermographic substrate 2 via the color changes 15. The color changes 15 representing the items of information 20*b*, 20*c* and 20*d* are formed patterned as shown in FIG. 1*b*. A pattern can, for example, be a graphically formed outline, a figural representation, an image, a motif, a symbol, a logo, a portrait, an alphanumeric character, a text and the like. Thus, a barcode is produced as item of information 20*b* by the color changes 15 activated in the thermographic substrate 2 in the region 10*b*. Furthermore, the color change 15 in the region 10*c* represents a cross as item of information 20*c* and the color changes 15 in the region 10*d* are formed in the shape of alphanumeric characters as text information.

FIG. 1*c* shows a document 1 with a thermographic substrate 2, wherein the document 1 has the item of information 20*e* in the region 10*e*, the item of information 20*f* in the region 10*f* and items of information in the form of alphanumeric characters in the regions 10*g* and 10*h*. Thus, a star is produced as item of information 20*e* by the color change 15 activated in the thermographic substrate 2 in the region 10*e*. Furthermore, the color changes 15 in the region 10*f* are formed in such a way that they represent a barcode as item of information 20*f*.

Figure 2A:
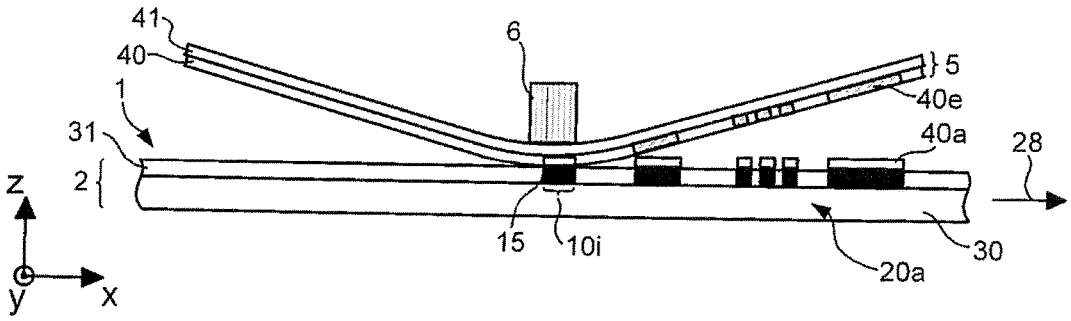
FIG. 2*b* shows a schematic sectional representation and top view of a document FIG. 3*a* schematically shows a method step for producing a document

FIG. 2*a* schematically shows a method step for producing a document 1 with a thermographic substrate 2. The method step shown in FIG. 2*a* corresponds to the method step shown in FIG. 1*a* with the difference that the film element 5 arranged between the thermal print head 6 which produces the temperature effect, and the thermographic substrate 2, comprises one or more first layers and one carrier layer 41, wherein the one or more first layers are transferred as transfer ply 40 in regions from the carrier layer 41 onto the document 1 by means of the thermal print head 6. The transfer ply 40 is thus formed by the one or more first layers of the film element.

The carrier layer 41 is preferably a layer made of plastic, for example of polyester with a layer thickness between 6 μm and 125 μm. The carrier layer 41 shown in FIG. 2*a* is made of polyethylene terephthalate (=PET) with a layer thickness of 4.5 μm. Between the carrier layer 41 and the transfer ply 40, a detachment layer is advantageously applied, which is preferably formed as a wax layer or alternatively from a strongly filming acrylate, which facilitates the detachment of the transfer ply 40 from the carrier layer 41.

As shown in FIG. 2*a*, during the introduction of the color change 15 in the region 10*i*, the transfer ply 40 of the film element 5 is applied to the document 1 in the region 10*i*. Thus, in the region 10*i*, on the one hand the color change 15 is caused by transferring the temperature effect from the thermal print head 6 through the film element 5 to the region 10*i* of the thermographic substrate 2, and on the other hand, the transfer ply 40 of the film element 5 is applied to the document 1 in the region 10*i*. The transfer ply 40 which is applied to the document 1 with the thermographic substrate 1, is thus arranged accurately fitting, i.e. precisely positioned relative to the color change 15 in the region 10*i*. As shown in FIG. 2*a*, thus in all regions in which a color change 15 is caused, the transfer ply 40 is also applied to the document 1. The transfer ply 40*a* applied to the document 1 is correspondingly removed from the film element 5, with the result that the transfer ply 40*e* is removed from the film element 5 in regions.

In FIG. 2*a*, during the activation of the color change 15 in the region 10*i* and the application of the first layers in the region 10*i*, the thermal print head 6 has a temperature between 70° C. and 220° C. The temperature effect induced by the thermal print head 6 in the region 10*i* of the thermographic substrate 2 is between 50° C. and 200° C.

Figure 2B:
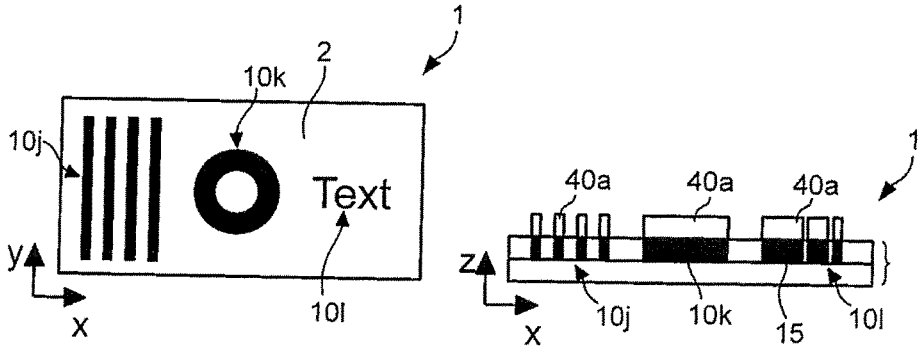

FIG. 2*b* shows a schematic sectional representation and top view of a document 1. FIG. 2*b* thus shows a document 1 with a thermographic substrate 2, wherein the document 1 has an item of information in each of the regions 10*j*, 10*k* and 10*l*. Furthermore, a color change 15 is activated in the regions 10*j*, 10*k* and 10*l* in the thermographic substrate 2, to represent the item of information. Furthermore, the transfer ply 40*a* is applied to the document 1 accurately fitting the color changes 15 in the regions 10*j*, 10*k* and 10*l*. The transfer ply 40*a* in the regions 10*j*, 10*k* and 10*l* is formed transparent. Furthermore, it is possible that the transfer ply 40*a* in the regions 10*j*, 10*k* and 10*k* is formed opaque, translucent or semi-transparent. Thus, for example, the transfer ply 40*a* can be formed opaque and red in color in the region 10*k*.

Figure 3A:
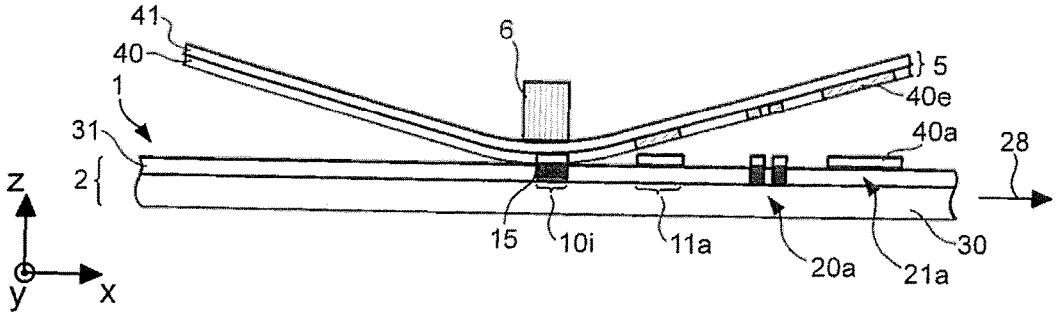
FIG. 3*b* and FIG. 3*c* show schematic top views and sectional representations of design variants of a document FIG. 4 to FIG. 6 schematically show method steps for producing a document

FIG. 3*a* schematically shows a method step for producing a document 1 with a thermographic substrate 2. The method step shown in FIG. 2*a* corresponds to the method step shown in FIG. 2*a*, with the difference that in the region 11*a*, the temperature effect causing the activation of the color change 15 has been selected such that the color change 15 is not activated in the region 11*a* and the transfer ply 40 of the film element 5 is applied to the document 1 to represent an item of information 21*a* by means of the thermal print head 6. As shown in FIG. 3*a*, the regions in which both the color change in the thermographic substrate 2 is activated and the transfer ply 40*a* is applied to the document 1 form an item of information 20*a*. Furthermore, the regions in which only the transfer ply 40*a* is applied to the document 1 form an item of information 21*a*. Thus, for example, items of information, such as the item of information 21*a*, which have a lesser relevance can be applied solely means of the transfer ply 40*a*, and items of information, such as the item of information 20*a*, which have a high relevance, for example an expiry date, can both be applied by means of the transfer ply 40 and introduced by the color change 15 in the thermographic substrate 2.

Figure 3B:
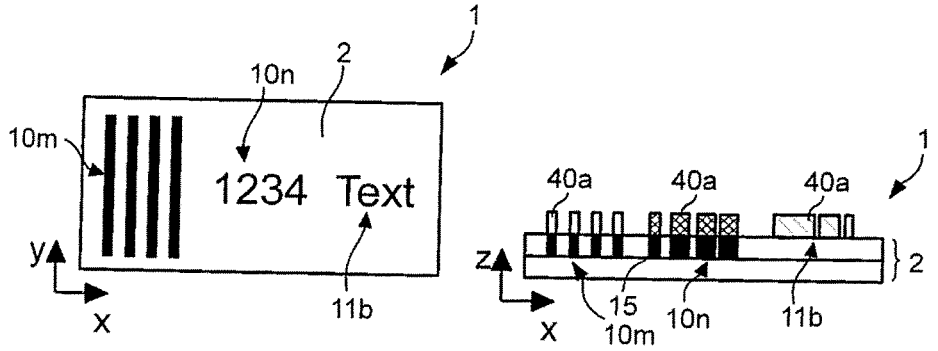
Figure 3C:
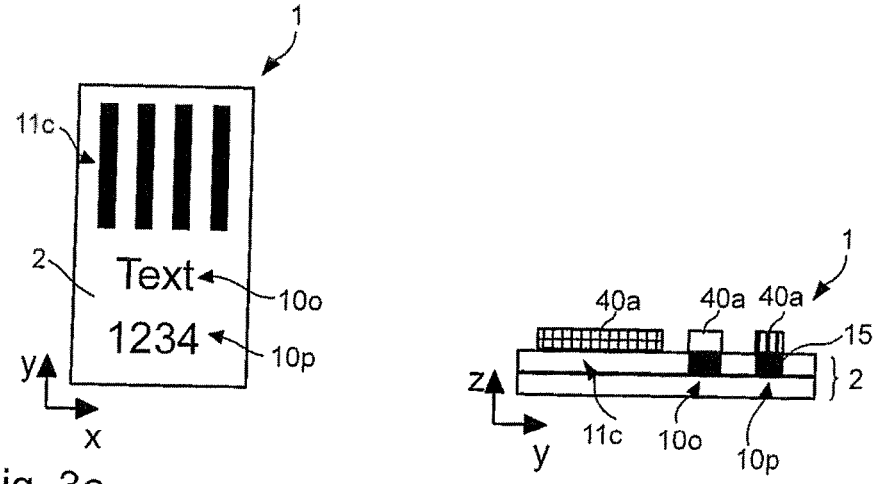

The temperature effect which is required for activation of the color change 15 in the thermographic substrate 2, is preferably higher than the temperature effect which is required for application of the transfer ply 40*a* to the document 1. The energy of the temperature effect for application of the transfer ply 40*a* to the document 1 is advantageously less than 82.5%, preferably less than 80%, of the energy of the temperature effect which is required for activation of the color change 15 in the thermographic substrate 2. Because of this lower energy requirement of the temperature effect for application of the transfer ply 40*a* to the document 1, it is thus possible, for example in the region 11*a* to apply solely the transfer ply 40*a* to the document 1, but not to activate the color change 15 in the thermographic substrate. In FIG. 3*a*, during the activation of the color change 15 in the region 10*i* and the application of the transfer ply in the region 10*i*, the thermal print head 6 has a temperature between 70° C. and 220° C., while, during the application of the transfer ply 40*a* in the region 11*a*, the thermal print head 6 has had a temperature between 57.75° C. and 181.5° C. FIG. 3*b* and FIG. 3*c* show schematic top views and sectional representations of design variants of a document 1.

FIG. 3*b* shows thus shows a document 1 with a thermographic substrate 2, wherein the document 1 has an item of information in each of the regions 10*m*, 10*n* and 11*b*. Furthermore, a color change 15 is activated in the regions 10*m* and 10*n* in the thermographic substrate 2 to represent the item of information. Furthermore, the transfer ply 40*a* is applied to the document 1 accurately fitting the color changes 15 in the regions 10*m* and 10*n*. Solely the transfer ply 40*a* is applied to the document 1 in the region 11*b*. The transfer ply 40*a* is formed transparent in the region 10*m*. In the regions 10*n* and 11*b*, the transfer ply 40*a* is formed colored in different colors, for example of the Pantone® color system (Pantone® Matching System—PMS).

FIG. 3*c* shows a document 1 with a thermographic substrate 2, wherein the document 1 has an item of information in each of the regions 10*o*, 10*p* and 11*c*. Furthermore, a color change 15 is activated in the regions 10*o* and 10*p* in the thermographic substrate 2 to represent the item of information. Furthermore, the transfer ply 40*a* is applied to the document 1 accurately fitting the color changes 15 in the regions 10*o* and 10*p*. Solely the transfer ply 40*a* is applied to the document 1 in the region 11*c*. The transfer ply 40*a* is formed transparent in the region 10*o*. In the regions 10*p* and 11*c*, the transfer ply 40*a* is formed colored in different colors, for example in red and green of the RGB color space.

Figure 4:
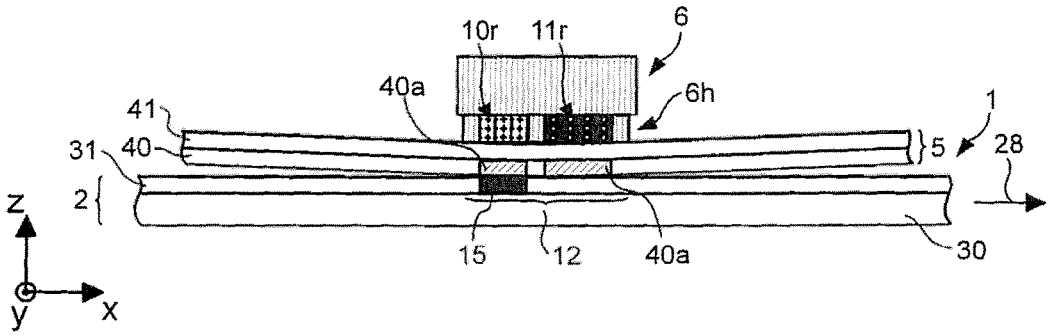

FIG. 4 schematically shows method steps for producing a document 1. The method step shown in FIG. 4 corresponds to the method step shown in FIG. 3*a*, with the difference that the region 10*r* and the region 11*r* are situated in the maximum recording range 12 of the thermal print head 6. The maximum recording range 12 of the thermal print head 6 corresponds to the maximum area of the thermal print head 6, with which the thermal print head 6 is in contact with the film element 5 during the activation of the color change 15.

The thermal print head 6 in FIG. 4 here has the heating elements 6*h*. The heating elements 6*h* of the thermal print head 6 touch the film element 5 in the recording range 12. Furthermore, the heating elements 6*h* of the thermal print head 6 are in contact with the film element 5, in such a way that the film element 5 also touches the document 1 over an area which corresponds to the recording range 12. The heating elements 6*h* of the thermal print head generate a temperature effect in the region 10*r*, such that, in the region 10*r*, both the color change 15 is activated in the thermographic substrate 2, and the transfer ply 40*a* is applied to the document 1. In the region 11*r*, the heating elements 6*h* of the thermal print head generate a temperature effect such that, in the region 11*r*, solely the transfer ply 40*a* is applied to the document 1. As already explained, the required effect of warmth or activation of the color change 15 in the thermographic substrate 2 is preferably higher than the effect of heat for application of the transfer ply 40*a* to the document 1, with the result that it is hereby made possible solely to apply the transfer ply 40*a* to the document 1 in the region 11*r*, wherein the heating elements 6*h* of the thermal print head in the region 11*r* have a lower temperature than the heating elements in the region 10*r*. The heating elements 6*h* in the region 10*r* can thus, for example, have a temperature of 100° C. and the heating elements 6*h* in the region 11*r* have a temperature of 80° C.

Figure 5:
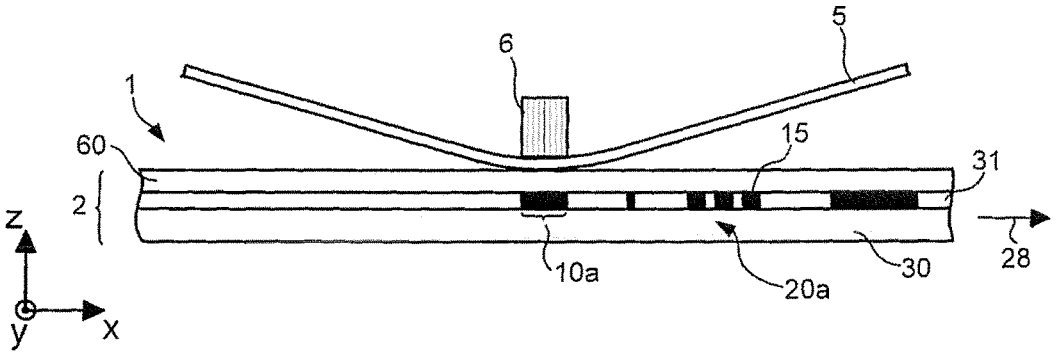

FIG. 5 shows a method step for producing a document 1. The method step shown in FIG. 5 corresponds to the method step shown in FIG. 1*a*, with the difference that the thermographic substrate 2 has second layers 60, wherein the second layers 60 are arranged between the film element 5 and the thermographic substrate 2. The second layers 60 are preferably formed transparent at least in regions, with the result that the color change 15 in the thermographic substrate 2 activated in the region 10*a* is recognizable through the second layers 60 that are transparent in regions. In FIG. 5, the temperature effect causing the activation of the color change 15 is transferred both through the second layers 60 and through the film element 5 to the region 10*a* of the thermographic substrate 2.

Figure 6:
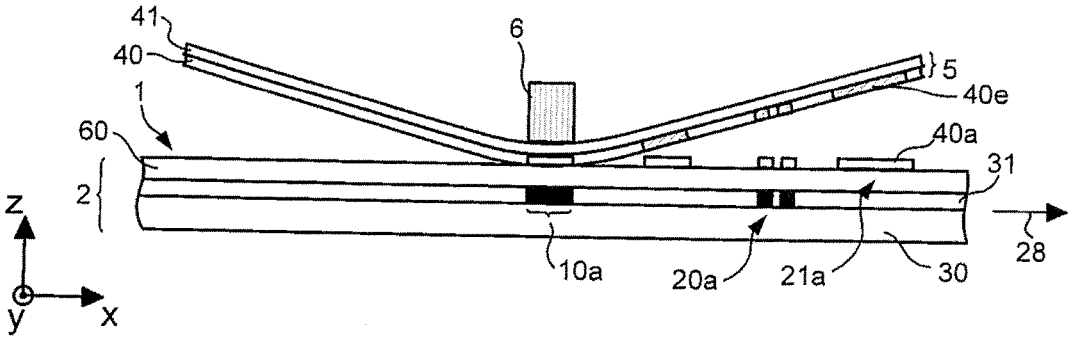

FIG. 6 shows a method step for producing a document 1. The method step shown in FIG. 6 corresponds to the method step shown in FIG. 3*a*, with the difference that the thermographic substrate 2 has one or more second layers 60, wherein the second layers 60 are arranged between the film element 5 and the thermographic substrate 2. As already explained, the temperature effect causing the activation of the color change 15 is transferred both through the second layers 60 and through the film element 5 to the region 10*a* of the thermographic substrate 2.

Figure 7A:
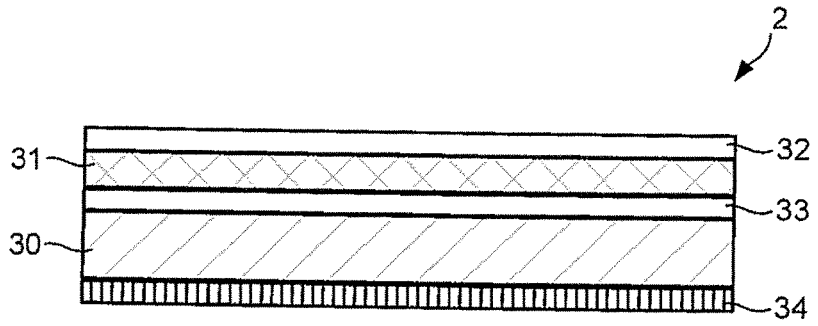
FIG. 7*a* and FIG. 7*b* show schematic sectional representations of design variants of a thermographic substrate
Figure 7B:
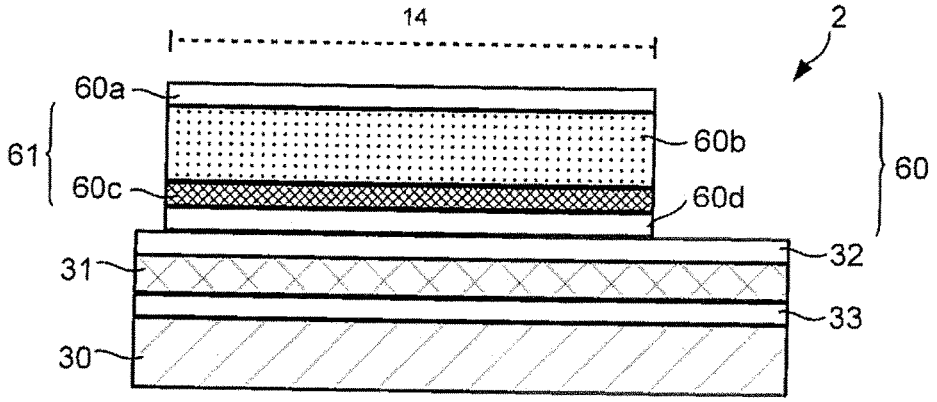

Design variants of the thermographic substrate 2 of FIG. 7*a* and FIG. 7*b* are explained below.

Thus FIG. 7*a* shows a thermographic substrate 2 which comprises a base layer 30, a thermosensitive layer 31, a protective layer 32, an intermediate layer 33 and a layer 34. With respect to the layers 30 and 31, reference is made here to the above statements.

The protective layer 32, also referred to as a coating, is preferably a polymer layer, in particular a polymer coating. Typical polymers here are PVA (polyvinyl alcohol), also modified PVA as well as copolymers with acrylic acids (acrylates) which result with cross-linking temperatures of approximately less than 70° C. (the cross-linking temperature must be below the reaction temperature of the thermally sensitive layer). Typical grammages lie between 1 g/m$^2$ and 5 g/m$^2$ oven-dry. The thickness of the protective layer 32 is usually between 1 μm, and 3 μm. (The thicker the layer, the better the protection, but the thermosensitive layer 31 becomes all the more insulated and thus the dynamic sensitivity becomes all the more impaired.) Pigments, for example PCC, and pyrogenic silicic acid, can also be added to the composition for the protective layer 32. The more pigments are contained, the better the printability of the thermographic substrate 2, for example by means of inkjet or offset printing, but the less good the impermeability and thus the protective function of the coating. In addition, part of the protective layer 32 has lubricants added, which are melted on during the thermal printing, make possible sliding of the thermal print head 6 and thus reduce abrasion. These are usually stearates (for example zinc or calcium soaps). As these substances have oily contents, the printability for example by means of inkjet or offset printing of the protective layer 32 diminishes in the case of higher contents. The protective layer 32 protects the thermographic substrate 2 for example vis-à-vis mechanical stress, chemical influences (for example against plasticizers), environmental influences, such as air humidity, or vis-à-vis printing optionally applied to the thermographic substrate 2. Furthermore, it is possible that the protective layer 32 is applied both to the upper side of the thermographic substrate 2 and to the lower side of the thermographic substrate 2.

The intermediate layer 33 is preferably a paper layer, in particular a paper coating which consists mainly of mineral pigments (for example calcium carbonate, kaolin) and/or hollow sphere pigments and polymer binders. The layer thickness is between 2 μm and 12 μm, the grammage between 3 $g/m^2$ and 15 $g/m^2$ oven-dry. The intermediate layer 33 makes possible an even and smooth surface, to which the thermosensitive layer 31 is applied. A high resolution and a high image quality are hereby made possible. Furthermore, a heat input into the base layer 30 is prevented and thus the sensitivity properties of the thermosensitive layer 31 are improved.

The protective layer 32 and/or the intermediate layer 33 can also be arranged on both sides of the base layer 30 in order to confer a good flatness on the thermographic substrate 2, but also to improve the impermeability (for example against starch solution) or the printability (pigment coating). The flatness is partially optimized merely with a rehumidifying system, i.e. water.

The layer 34 is preferably a printed color layer 34 with a layer thickness between 0.8 μm and 10 μm. Furthermore, it is possible that the layer 34 is a layer which has pigments which, in the case of irradiation with electromagnetic radiation, preferably in the case of irradiation with UV and/or IR light, emit light from the range of the wavelength range visible to the human eye, in particular in the wavelength range from 380 nm to 780 nm. It is possible that the layer 34 is applied in regions. Furthermore, it is possible that the regions in which the layer 34 is applied in regions, are formed patterned, for example in the form of a logo or alphanumeric character. Furthermore, a pattern can, for example, be a graphically formed outline, a figural representation, an image, a motif, a symbol, a portrait, a text and the like.

FIG. 7*b* shows a thermographic substrate 2, which has second layers 60 in the region 14. With respect to the design of the layers 30, 31, 32 and 33, reference is made here to the above statements. The second layers 60 are preferably formed transparent at least in regions. Furthermore, it is also possible that the second layers 60 are stained at least in regions. It is thus also possible that the second layers 60 are formed opaque at least in regions.

The second layers 60 comprise a protective varnish layer 60*a*, a replication varnish layer 60*b*, a reflective layer 60*c* and a bonding layer 60*d*. The layers 60*b* and 60*c* here form a decorative layer 61. The protective varnish layer 60*a* is preferably formed transparent. It is also possible that the protective varnish layer 60*a* is stained at least in regions. The protective varnish layer 60*a* preferably has a layer thickness of 1 μm. The protective varnish layer 60*a* is preferably a layer of PMMA, PVC, acrylate and/or carnauba wax.

The replication varnish layer 60*b* preferably consists of a thermoplastic replication varnish layer with a layer thickness between 1 μm and 5 μm. In the surface of the replication layer 60*b* oriented to the reflective layer 60*c*, a relief structure is molded at least in regions by means of a corresponding replication tool using heat and pressure, with the use of a thermoplastic replication layer. Furthermore, it is also possible that the replication varnish layer 60*b* is formed by a UV-crosslinkable varnish and the relief structure is molded into the replication varnish layer 60*b* by means of UV replication. The relief structure is molded onto the uncured replication varnish layer 60*b* by the action of a stamping tool and the replication varnish layer 60*b* is cured before and/or directly during and/or after the molding by irradiation with UV light.

The relief structures can be the relief structure of a 2D/3D hologram, which is generated holographically and is copied onto a replication master. Furthermore, the relief structures can also be computer-generated holograms and diffractive elements, for example a Kinegram®. Such relief structures preferably have a spatial frequency between 100 lines/mm and 5000 lines/mm and optionally have a plurality of different regions which are covered with relief structures which differ in their spatial frequency, their azimuth angle and/or relief form, and thus generate a desired optically variable appearance. Furthermore, the relief structures can also be relief structures which form mat structures, in particular anisotropic mat structures. By anisotropic mat structures is meant here mat structures the scattering characteristics of which are dependent on the observation angle and thus exhibit an optically variable appearance. These mat structures are preferably generated holographically, but can also be formed by a corresponding computer-generated arrangements of diffractive elements.

Furthermore, it is possible that the relief structures form refractive elements, for example lenses, microlens grids or microprisms. Furthermore, it is also possible that the relief structures form a zero-order diffraction structure. These diffraction structures are formed by gratings, in particular regular gratings, for example crossed gratings or linear gratings, in which the spacing of the individual structural elements with respect to each other is smaller than a wavelength A in the visible light range. A striking optically variable security feature is provided by such relief structures, in which a color change is shown to the observer on turning.

The reflective layer 60*c* is preferably a metal layer and/or an HRI or LRI layer (HRI—high refraction index, LRI—low refraction index).

It is thus possible that the reflective layer 60*c* is formed as a metal layer made of chromium, aluminum, gold, copper, silver or an alloy of such metals. The metal layer is preferably vapor-deposited in a vacuum in a layer thickness of from 10 nm to 150 nm.

Furthermore, it is also possible that the reflective layer 60*c* is formed by a transparent reflective layer, preferably a thin or finely-structured metallic layer or a dielectric HRI or LRI layer. Such a dielectric reflective layer consists, for example, of a vapor-deposited layer made of a metal oxide, metal sulfide, e.g. titanium oxide etc. with a thickness of from 25 nm to 500 nm.

Furthermore, it is possible that the reflective layer 60*c* is shaped in regions. It is also possible that the reflective layer 60*c* is formed patterned. A pattern can, for example, be a graphically formed outline, a figural representation, an image, a motif, a symbol, a logo, a portrait, an alphanumeric character, a text and the like. For this purpose, the reflective layer 60*c* can be structured by means of known processes, in particular removed in regions. For example, this can take place by means of known etching processes and/or washing processes.

In FIG. 7*b*, the layers 60*b* and 60*c* form the decorative layer 61, providing a security feature. It is however also possible that the decorative layer 61 has one or more layers providing the security feature, which contain one or more elements selected from the group: a security print, a UV or IR print, a microprint, a layer containing optically variable pigments, a refractive element, a diffractive element, an anisotropic mat structure, a relief hologram, a volume hologram, a zero-order diffraction structure, a thin film layer element and/or a cross-linked liquid crystal layer generating a color shift effect dependent on the viewing angle.

The bonding layer 60*d* is preferably a cold adhesive layer, by means of which the second layers 60 are applied to the layer 32. By cold adhesive layer is here meant an adhesive layer with which the adhesive force provided by the adhesive layer is activated between the layers 60*c*, 32 surrounding the cold adhesive layer solely by pressing the layers 60*c* and 32 together, i.e. is activated without using heat. Conventional adhesives curing without the effect of pressure and irradiation or adhesives curing under the effect of pressure are used as cold adhesives for example. Furthermore, it is also possible that a UV-curable adhesive layer is used. The curing of the UV-curable adhesive layer preferably takes place with UV radiation of a wavelength between approximately 250 nm and approximately 400 nm. The bonding layer 60*d* is preferably formed transparent in the wavelength range visible to the human eye, in particular formed transparent and clear. By "transparent" is meant a transmissivity in the wavelength range visible to the human eye of more than 50%, further preferably more than 80%, further preferably of 90%. By "clear" is meant a layer in which less than 50%, further preferably less than 80% of the light transmitted through the layer is scattered. The bonding layer 60*d* preferably has a layer thickness between 1 μm and 10 μm, preferably between 1 μm and 5 μm.

Advantageously, the second layers 60 are applied to the thermographic substrate by means of cold-embossing, with the result that undesired color changes in the thermosensitive layer 31 are prevented during application of the second layers 60.

Figure 8A:
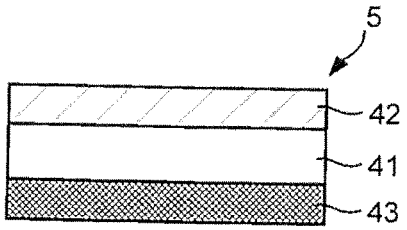
FIG. 8*a* to FIG. 8*p* show schematic sectional representations of design variants of a film element

Design variants of a film element 5 or of the first layers of a film element 5 are explained below. FIG. 8*a* to FIG. 8*p* thus show sectional representations of design variants of a film element 5. The film elements of FIG. 8*b* to FIG. 8*p* here have first layers which can be applied to a document. Thus, the first layers of the film elements 5 are formed as transfer plies 40, wherein the transfer plies 40 are applied to a document by means of a thermal print head. It is thus possible that in particular the film elements of FIG. 8*b* to FIG. 8*p* are transfer films, in particular thermal transfer films.

FIG. 8*a* shows a film element 5 which has a heat-resistant layer 42, a carrier layer 41 and a sliding layer 43. With respect to the carrier layer 41, reference is made here to the above statements. The heat-resistant layer 42 and the sliding layer 43 are layers of polyester resin and polysiloxane. The heat-resistant layer 42 and the sliding layer 43 preferably each have an application weight of 0.25 g/m$^2$. The film element 5 of FIG. 8*a* is a film element that has no transfer ply which can be transferred to a document.

Figure 8B:
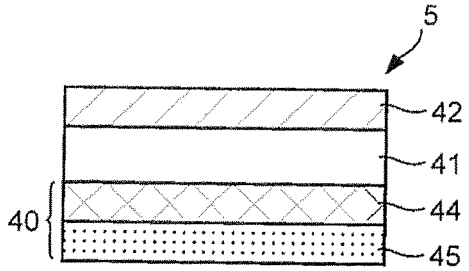

FIG. 8*b* shows a film element 5 which has a heat-resistant layer 42, a carrier layer 41, a transparent protective varnish layer 44 and an adhesive layer 45. With respect to the layers 41 and 42, reference is made here to the above statements. The transparent protective varnish layer 44 is, for example, a layer of polymethyl methacrylate, PVC, acrylate and/or carnauba wax. The transparent protective varnish layer 44 preferably has an application weight of 0.4 g/m$^2$. The adhesive layer 45 preferably has an application weight between 1.5 g/m$^2$ and 5 g/m$^2$ and comprises acrylates, PVC (=polyvinyl chloride), PUR (=polyurethane) or polyester. The film element 5 of FIG. 8*b* is a film element in which the layers 44 and 45 can be transferred to a document as transfer ply 40.

Figure 8C:
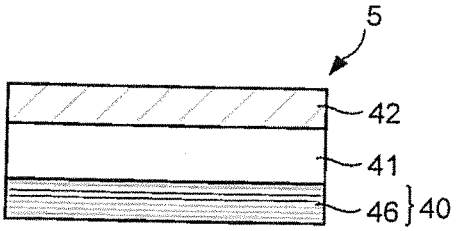

FIG. 8*c* shows a film element 5 which has a heat-resistant layer 42, a carrier layer 41 and a layer 46 having color pigments and/or dissolved dyes. With respect to the layers 41 and 42, reference is made here to the above statements. The layer 46 having the color pigments and/or dissolved dyes is, for example, a layer of carnauba wax, polyurethane, ethylene vinyl acetate, styrene acrylate and color pigments. The layer 46 preferably has an application weight of 4 g/m$^2$. The film element 5 of FIG. 8*c* is a film element in which the layer 46 can be transferred to a document as transfer ply 40.

Figure 8D:
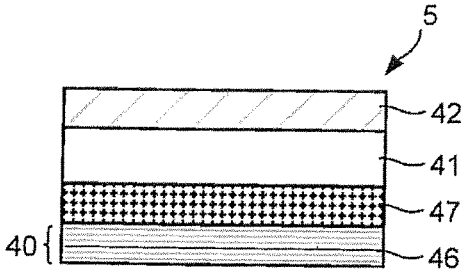

FIG. 8*d* shows a film element 5 which has a heat-resistant layer 42, a carrier layer 41, a detachment layer 47 and a layer 46 having color pigments and/or dissolved dyes. With respect to the layers 41, 42, and 46, reference is made here to the above statements. The detachment layer 47 is preferably a wax layer, in particular of candelilla wax and montan acid wax or, alternatively, a layer of strongly filming acrylate. The detachment layer 47 preferably has an application weight of 1.7 g/m$^2$. The film element 5 of FIG. 8*d* is a film element in which the layer 46 can be transferred to a document as transfer ply 40.

Figure 8E:
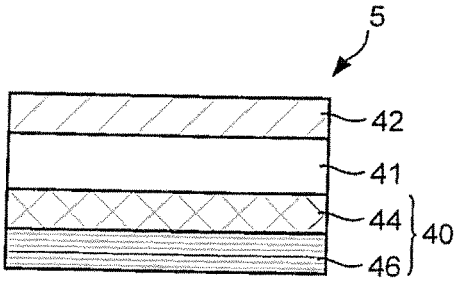

FIG. 8*e* shows a film element 5 which has a heat-resistant layer 42, a carrier layer 41, a transparent protective varnish layer 44 and a layer 46 having color pigments and/or dissolved dyes. With respect to the layers 41, 42, 44 and 46, reference is made here to the above statements. The film element 5 of FIG. 8*e* is a film element in which the layers 44 and 46 can be transferred to a document as transfer ply 40.

Figure 8F:
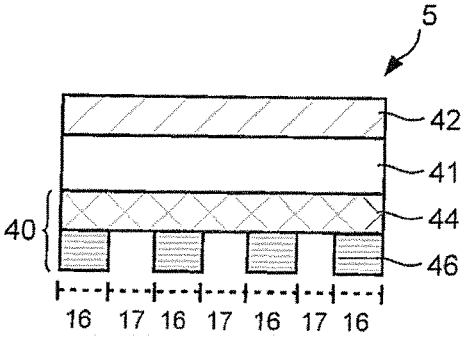

FIG. 8*f* corresponds to FIG. 8*e* with the difference that the layer 46 having the color pigments and/or dissolved dyes is applied in the regions 16 and is not applied in the regions 17. The regions 16 and/or the regions 17 can be formed patterned, for example in the form of alphanumeric characters or motifs. It is also possible that the regions 16 and/or the regions 17 are formed in the form of a graphically formed outline, a figural representation, an image, a symbol, a logo, a portrait, a text and the like. The regions 16 and the regions 17 are preferably arranged according to a grid. The resolution limit of the grid can here be greater than the resolution limit of the naked human eye, in particular greater than 300 μm.

Figure 8G:
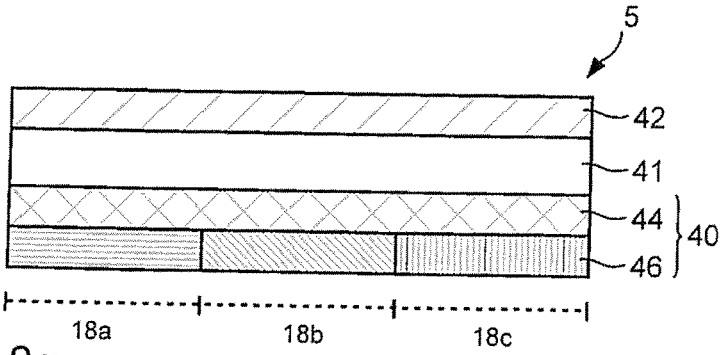

FIG. 8*g* corresponds to FIG. 8*e* with the difference that the layer 46 having the color pigments and/or dissolved dyes has different color pigments and/or dissolved dyes in the regions 18*a*, 18*b* and 18*c*. Thus, the layer 46 can for example be red in color in the region 18*a*, green in color in the region 18*b* and yellow in color in the region 18*c*. It is possible that the regions 18*a*, 18*b* and 18*c* are different colors, which can be represented in a color model such as e.g. the RGB color model or the CMYK color model as a color dot within a color space. Furthermore, it is possible that the regions 18*a*, 18*b* and 18*c* are different colors, for example of the Pantone® color system. The regions 18*a*, 18*b* and 18*c* can be formed patterned. The regions 18*a*, 18*b* and 18*c* are preferably formed in the form of strips.

Figure 8H:
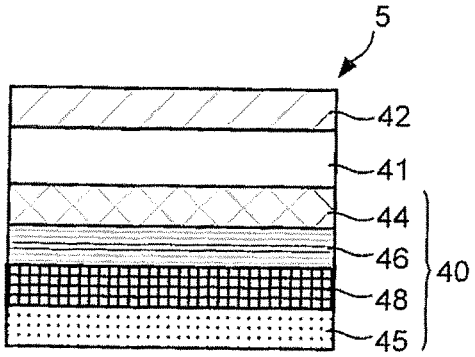

FIG. 8*h* shows a film element 5 which has a heat-resistant layer 42, a carrier layer 41, a transparent protective varnish layer 44, a layer 46 having color pigments and/or dissolved dyes, a metal layer 48 and an adhesive layer 45. With respect to the layers 41, 42, 44 and 45, reference is made here to the above statements. The layer 46 in FIG. 8*h* preferably has an application weight between 1.0 g/m$^2$ and 3 g/m$^2$ and formed semi-transparent. With respect to the further design of the layer 46, reference is made to the above statements. The metal layer 48 is a metal layer of aluminum, preferably with a layer thickness between 10 nm and 100 nm. It is also possible that the metal layer 48 is formed of chromium, gold, copper, silver or an alloy of such metals. The metal layer 48 is preferably vapor-deposited in a vacuum. The film element 5 of FIG. 8*h* is a film element in which the layers 44, 46, 48 and 45 can be transferred to a document as transfer ply 40.

Figure 8I:
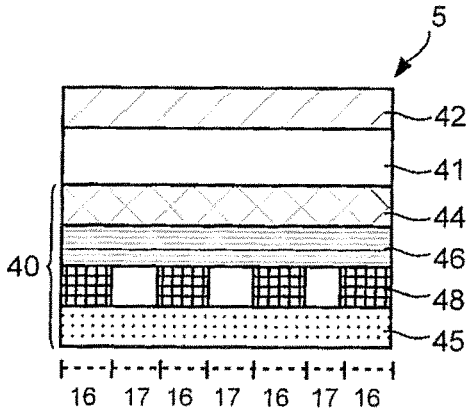

FIG. 8*i* corresponds to FIG. 8*h* with the difference that the metal layer 48 is applied in the regions 16 and is not applied in the regions 17. With respect to the design of the regions 16 and/or the regions 17, reference is made here to the above statements.

Figure 8J:
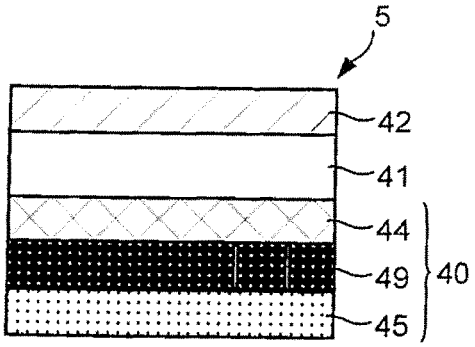

FIG. 8*j* shows a film element 5 which has a heat-resistant layer 42, a carrier layer 41, a transparent protective varnish layer 44, a fluorescent varnish layer 49 and an adhesive layer 45. With respect to the layers 41, 42, 44 and 45, reference is made here to the above statements. The fluorescent varnish layer 49 has pigments which, in the case of irradiation with electromagnetic radiation, preferably in the case of irradiation with UV light, emit light from the range of the wavelength range visible to the human eye, in particular in the wavelength range from 380 nm to 780 nm. The application weight of the fluorescent varnish layer 49 is preferably between 0.5 g/m$^2$ and 2 g/m$^2$. Furthermore, it is possible that the fluorescent varnish layer 49 is applied in regions. For example, fine-lined security patterns such as for example complex guilloche patterns or other motifs can be formed hereby. The film element 5 of FIG. 8*j* is a film element in which the layers 44, 49 and 45 can be transferred to a document as transfer ply 40.

Figure 8K:
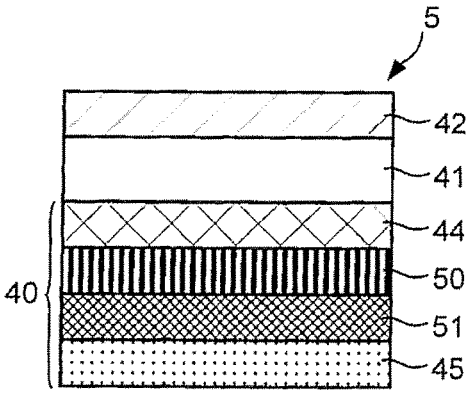

FIG. 8*k* shows a film element 5 which has a heat-resistant layer 42, a carrier layer 41, a transparent protective varnish layer 44, a replication varnish layer 50 and an HRI layer 51. With respect to the layers 41, 42, 44 and 45, reference is made here to the above statements. The replication varnish layer 50 preferably has an application weight between 0.2 g/m$^2$ and 1.5 g/m$^2$. The replication varnish layer 50 in FIG. 8*k* is a layer of PMMA and styrene copolymer, which is stamped with a relief structure on the side facing the HRI layer. The relief structure is preferably a diffractive relief structure, in particular selected from the group Kinegram® or hologram, zero-order diffraction structure, blazed grating, in particular asymmetrical saw-tooth relief structure, diffraction structure, in particular linear sinusoidal diffraction grating, or crossed sinusoidal diffraction grating or linear single- or multi-step rectangular grating, or crossed single- or multi-step rectangular grating, light-diffracting and/or light-refracting and/or light-focusing micro- or nanostructure, binary or continuous Fresnel lens, binary or continuous Fresnel freeform surface, diffractive or refractive macrostructure, in particular lens structure or microprism structure, mirror surface, mat structure, in particular anisotropic or isotropic mat structure, or combinations of these structures. With respect to the further design of the replication varnish layer 50, reference is made here to the above statement within the context of the replication varnish layer 60*b*. The HRI layer 51 in Fig. consists, for example, of a vapor-deposited layer of ZnS with a thickness of 20 nm to 120 nm. With respect to the further design of the HRI layer 51, reference is made here to the above statement within the context of the reflective layer 60*c*. The film element 5 of FIG. 8*k* is a film element in which the layers 44, 50, 51 and 45 can be transferred to a document as transfer ply 40.

Figure 8L:
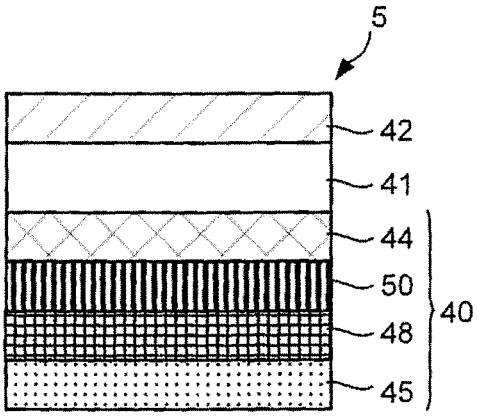

FIG. 8*l* shows a film element 5 which has a heat-resistant layer 42, a carrier layer 41, a transparent protective varnish layer 44, a replication varnish layer 50, a metal layer 48 and an adhesive layer 45. With respect to the layers 41, 42, 44, 45, 48 and 50, reference is made here to the above statements. The film element 5 of FIG. 8*l* is a film element in which the layers 44, 50, 48 and 45 can be transferred to a document as transfer ply 40.

Figure 8M:
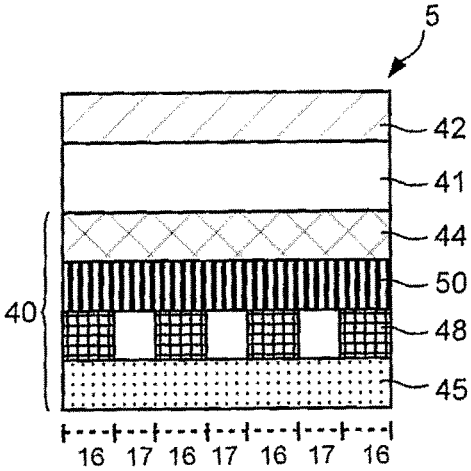

FIG. 8*m* corresponds to FIG. 8*l* with the difference that the metal layer 48 is applied partially in the regions 16 and is not applied in the regions 17.

Furthermore, it is possible that the film element 5 has a further optional varnish layer, not shown in more detail, between the layers 45 and 48, which varnish layer is for example used as an etch resist for structuring a metal layer applied over the whole surface. The optional varnish layer and/or replication varnish layer 50 and/or the transparent protective varnish layer 44 is preferably stained.

Thus, it is for example possible that the replication varnish layer 50 is stained yellow. With respect to the design of the regions 16 and/or the regions 17, reference is made here to the above statements.

Figure 8N:
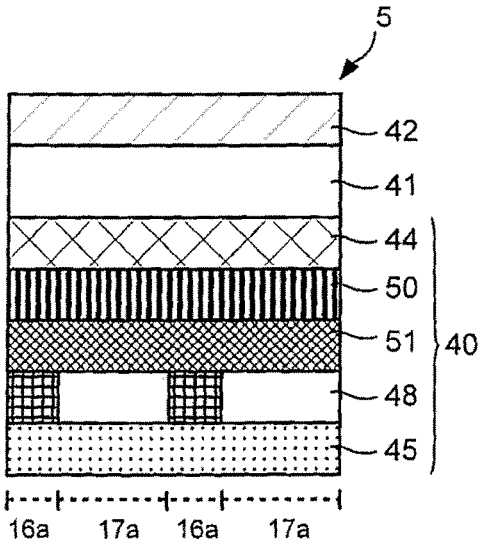

FIG. 8*n* shows a film element 5 which has a heat-resistant layer 42, a carrier layer 41, a transparent protective varnish layer 44, a replication varnish layer 50, an HRI layer 51, a metal layer 48 and an adhesive layer 45. In FIG. 8*n* the metal layer 48 is applied in the regions 16*a* and not applied in the regions 17*a*. With respect to the layers 41, 42, 44, 45, 48, 50 and 51, reference is made here to the above statements. With respect to the design of the regions 16*a* and/or the regions 17*a*, reference is made here to the above statements in the context of the regions 16 and 17. The film element 5 of FIG. 8*n* is a film element in which the layers 44, 50, 51, 48 and 45 can be transferred to a document as transfer ply 40.

Figure 8O:
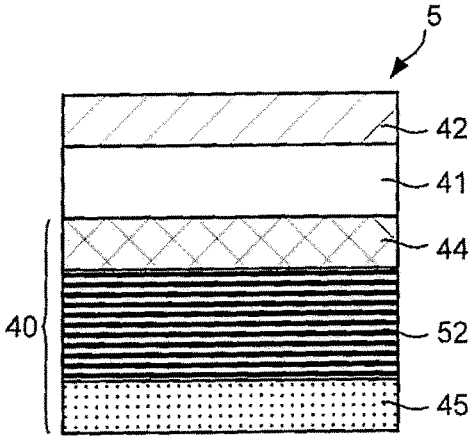
Figure 8P:
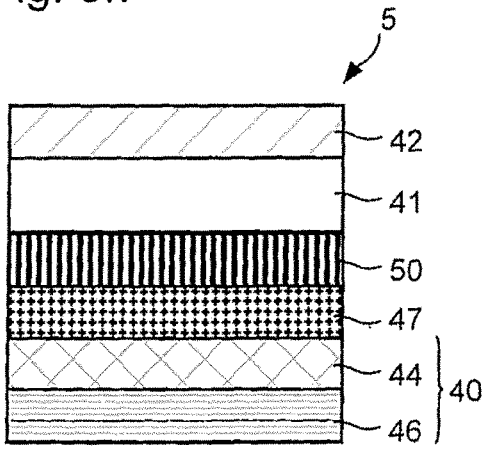

FIG. 8*o* shows a film element 5 which has a heat-resistant layer 42, a carrier layer 41, a transparent protective varnish layer 44, a layer 52 having optically variable pigments and an adhesive layer 45. With respect to the layers 41, 42, 44 and 45, reference is made here to the above statements. By "optically variable pigments" is here meant pigments which produce a color effect, in particular due to interference effects, which is dependent on the observation angle. In order to produce such a color-change effect with a high degree of brilliance, the pigments must have a similar orientation to each other. Such pigments are, for example, optically variable pigments (OVPs). In addition to the optically variable pigments, layer 52 preferably also has a binder. Such combinations of binders and pigments are, for example, optically variable inks (OVI®). OVIs typically have to be printed in significant layer thicknesses in order to produce a recognizable color-change effect with a high degree of brilliance.

The application weight of the layer 52 is preferably between 1.0 g/m$^2$ and 10 g/m$^2$. Furthermore, it is possible that the layer 52 is applied in regions, in particular patterned. For example, alphanumeric characters can be formed. It is also possible that the layer 52 is formed as a thin film layer system. A thin film layer system has one or more space layers, the layer thickness of which is selected so that the thin film layer system, by means of interference of the incident light, generates a color shift effect dependent on the observation angle, in particular out of the range of the wavelength range visible to the human eye. Such a thin film layer system is characterized in particular by one or more space layers. The optically effective layer thickness of these space layers, preferably for a specific viewing angle, fulfils the $\lambda/2$ or $\lambda/4$ condition for a wavelength $\lambda$ in particular in the range of visible light. The thin film layer system can here consist of a single layer, of a layer system with one or more dielectric layers and one or more metallic layers or of a layer stack with two or more dielectric layers. The film element 5 of FIG. 8*o* is a film element in which the layers 44, 52 and 45 can be transferred to a document as transfer ply 40.

FIG. 8*p* shows a film element 5 which has a heat-resistant layer 42, a carrier layer 41, a replication varnish layer 50, a detachment layer 47, a transparent protective varnish layer 44 and a layer 46 having color pigments and/or dissolved dyes. The film element 5 of FIG. 8*p* is a film element in which the layers 44 and 46 can be transferred to a document as transfer ply 40. A relief structure is stamped into the replication varnish layer 50 at least in regions. The detachment layer is preferably a thin wax layer, the application weight of which is 0.01 g/m$^2$. During the application of the layers 44 and 46 to a document, a relief structure that is inverted with respect to the relief structure of the replication varnish layer 50 is molded into the transparent protective varnish layer 44. During the application, the transparent protective varnish layer 44, together with the layer 46, is separated from the detachment layer 47. The negative form of the relief structure molded into the replication varnish layer 50 is hereby molded onto the transparent protective varnish layer 44 and the layers 44 and 46 are simultaneously transferred to a document. With respect to the further design of the layers 41, 42, 44, 46, 47 and 50, reference is made here to the above statements.

FIG. 9 to FIG. 12 show schematic top views and sectional representations of design variants of a document 1.

Figure 9:
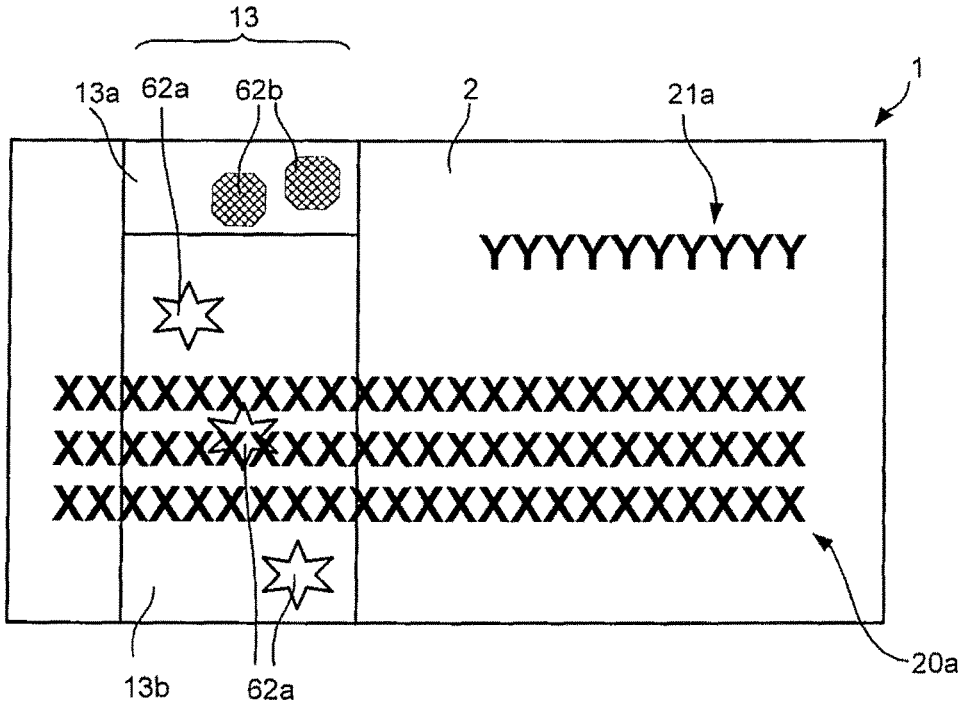
FIG. 9 to FIG. 12 show schematic top views and sectional representations of design variants of a document

FIG. 9 thus shows a document 1 with a thermographic substrate 2, which has second layers in the region 13. In the region 13*a*, the second layers are formed opaque and further have the security features 61*b*. The security features 61*b* are, for example, a zero-order diffraction structure. The region 13*b* is formed transparent and comprises the security elements 61*a*, which are formed in the shape of a star as shown in FIG. 9 and form a volume hologram. The region 13 extends over the entire width of the document 1, as shown in FIG. 9. A first item of information 20*a* is further introduced into the thermographic substrate 2 by activation of the color change 15 in the thermographic substrate 2. The document 1 further has first layers which represent a second item of information 21*a*. The document 1 is, for example, a ticket. With respect to the introduction of the first item of information 20*a* into the thermographic substrate 2 of the document 1 and the application of the first layers to the document 1 to represent the second item of information 21*a*, reference is made here to the above statements.

Figure 10:
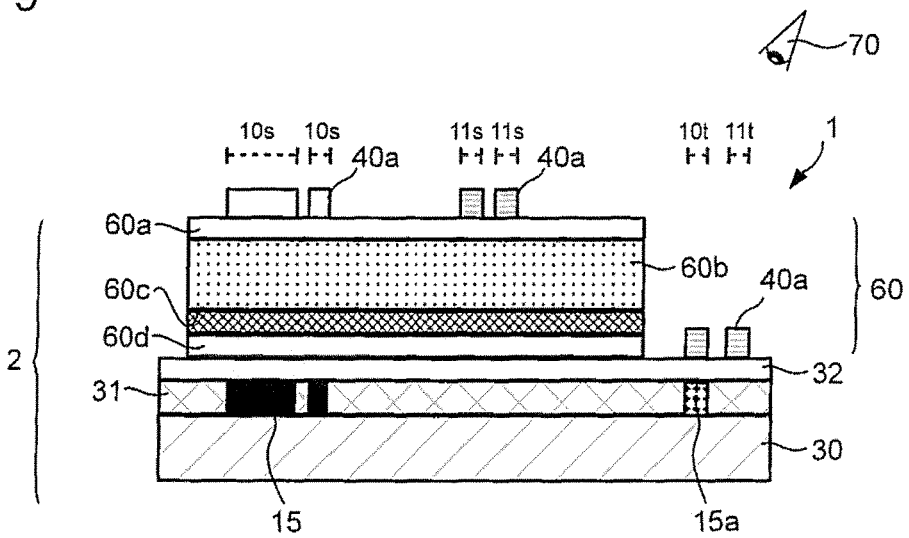

FIG. 10 shows a document 1 with a thermographic substrate 2. In regions, the thermographic substrate 2 has the second layers 60, which comprise the layers 60*a*, 60*b*, 60*c* and 60*d*. With respect to the design of the layers 60*a*, 60*b*, 60*c* and 60*d*, reference is made here to the above statements. A color change 15 is activated in the regions 10*s* in the thermographic substrate 2, which appears black to an observer 70. Furthermore, the transfer ply 40*a* is applied to the thermographic substrate 2 in the regions 10*s*. In the region 10*s*, the transfer ply 40*a* is formed as a protective varnish layer and transparent. The transfer ply 40*a* is applied to the thermographic substrate 2 in the regions 11*s*, which have red color pigments and are opaque. A color change 15*a* is activated in the region 10*t* in the thermographic substrate 2, which appears colored magenta to an observer 70. The thermosensitive layer 31 in FIG. 10 has two different color changes 15, 15*a* depending on the temperature effect. Thus, the color change 15 of the thermosensitive layer 31 in FIG. 10 is activated at a temperature of approximately 100° C. in the regions 10*s* and the color change 15*a* is already activated at a temperature of approximately 90° C. in the region 10*t*. Furthermore, the transfer ply 40*a* is applied to the thermographic substrate 2 in the regions 10*t* and 11 *t*, which are stained green and are formed transparent.

Figure 11:
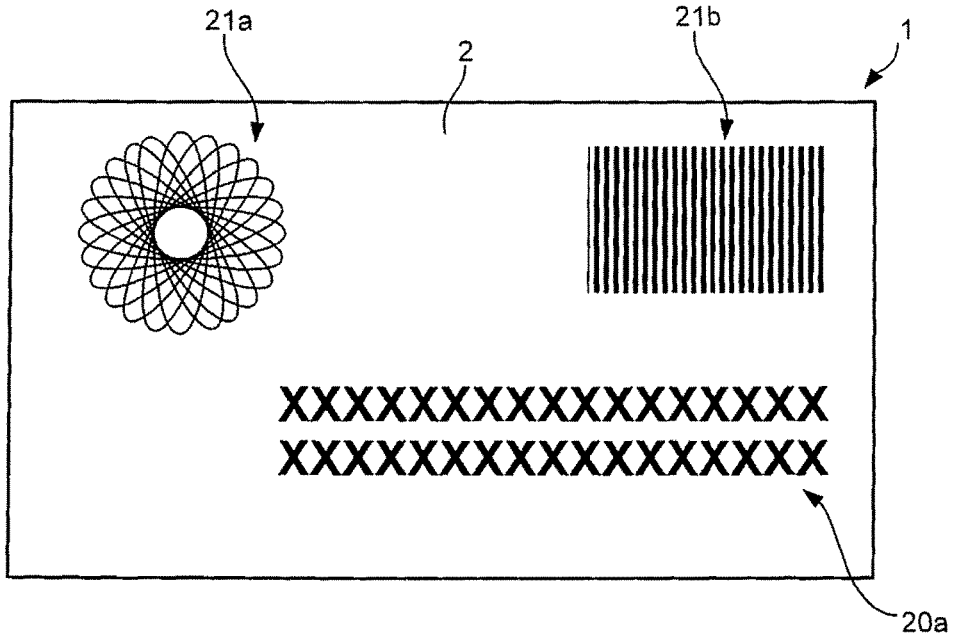

FIG. 11 shows a document 1 with a thermographic substrate 2. A first item of information 20*a* is introduced into the thermographic substrate 2. The first item of information 20*a* is introduced by activation of the color change in the thermographic substrate 2. The document 1 further has first layers in the form of a fine-lined figure for representation of a second item of information 21*a*. The document 1 further has a transfer ply in the form of a barcode for representation of a second item of information 21*b*. The document 1 is, for example, a travel ticket. With respect to the introduction of the first item of information 20*a* into the thermographic substrate 2 of the document 1 and the application of the transfer ply for representation of the second items of information 21*a* and 21*b* to the document 1, reference is made here to the above statements.

Figure 12:
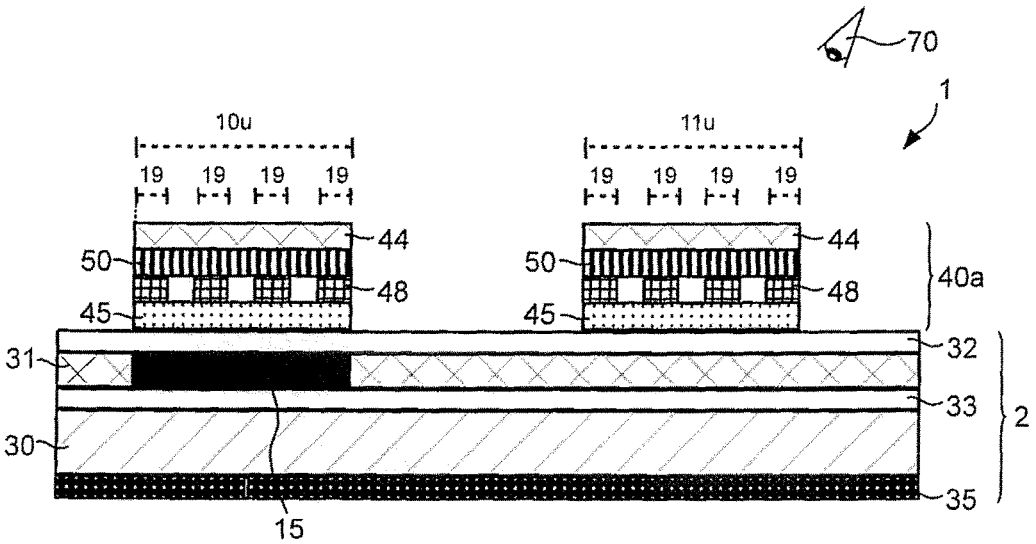

FIG. 12 shows a document 1 with a thermographic substrate 2. In the regions 10 and 11*u*, the document 1 has the transfer ply 40*a* which comprises the layers 44, 50, 48 and 45. With respect to the design of the layers 44, 50, 48 and 45, reference is made here to the above statements. A color change 15 is activated in the region 10*u* in the thermographic substrate 2, which appears black to an observer 70. The layer 48 is present only in the regions 19. The regions 19 are arranged in the form of a grid with grid widths of 350 μm, with the result that an observer 70 can recognize the color change 15 activated in the region 10*u*. The color change 15 is not activated in the thermographic substrate 2 in the region 11*u*. With respect to the layers 30, 31, 32, 33 of the thermographic substrate 2, reference is made here to the above statements. The layer 35 is a layer which has pigments which, in the case of irradiation with electromagnetic radiation, preferably in the case of irradiation with UV and/or IR light, emit light from the range of the wavelength range visible to the human eye, in particular in the wavelength range from 380 nm to 780 nm. It is possible that the layer 35 is applied, in particular patterned, in regions.

LIST OF REFERENCE NUMBERS

1 document
2 thermographic substrate
5 film element
6 thermal print head
6*h* heating elements
10*a*, 10*b*, 10*c*, 10*d*, 10*e*, first region
10*f*, 10*g*, 10*h*, 10*i*, 10*j*,
10*k*, 101, 10*m*, 10*n*, 10*o*,
10*p*, 10*r*, 10*s*, 10*t*, 10*u*
11*a*, 11*b*, 11*c*, 11*q*, 11 *r*,
11*s*, 11*t*, 11*u* second region
12 recording range
13, 13*a*, 13*b*, 14 regions
15 color change
16, 17, 18*a*, 18*b*, 18*c*, 19 partial regions
20*a*, 20*b*, 20*c*, 20*d*, 20*e*, first item of information
20*f*
21*a*, 21*b* second item of information
25, 26, 27 co-ordinate axes x, y, z
28 feed direction
30 base layer
31 thermosensitive layer
32 protective layer
33 intermediate layer
34, 35 third layers

40 transfer ply
40*a* applied transfer ply
40*e* removed transfer ply
41 carrier layer
42 heat-resistant layer
43 sliding layer
44 transparent protective varnish layer
45 adhesive layer
46 layer having color pigments and/or dissolved dyes
47 detachment layer
48 metal layer
49 fluorescent varnish
50 replication varnish layer
51 HRI layer
52 layer having optically variable pigments
60 second layers
60*a* protective varnish layer
60*b* replication varnish layer
60*c* reflective layer
60*d* bonding layer
61 decorative layer
62*a*, 62*b* security features
70 observer

The invention claimed is:

1. A method for producing a security document, with a thermographic substrate, the method comprising:

(a) providing the thermographic substrate, the thermographic substrate having a thermosensitive layer comprising color-producing substances which, under the effect of warmth, react chemically, such that the thermographic substrate is caused to undergo a color change depending on temperature effect in at least one first region;

(b) arranging a film element in such a way that the film element is arranged between the at least one first region of the thermographic substrate and a thermal print head, the film element having a transfer ply comprising one or more first layers; and (c) introducing at least one first item of information by means of the thermal print head by:

i) warming the thermographic substrate to chemically react the color-producing substances of the thermosensitive layer in the at least one first region of the thermographic substrate, and ii) applying the transfer ply of the film element in the at least one first region of the thermographic substrate, wherein the thermal print head, during the introduction of the at least one first item of information while applying the transfer ply of the film element in the at least one first region of the thermographic substrate, is in contact with the film element, in such a way that the temperature effect causing the activation of the color change is transferred from the thermal print head through the film element to the at least one first region of the thermographic substrate.

2. The method according to claim 1, wherein, in step c), by color change of the thermographic substrate in the at least one first region, a first color is produced and the one or more first layers of the film element which are applied to the security document, in the at least one first region in step c), are formed colored in a second color at least in regions, wherein the first color and the second color are different colors, of the RGB color space.

3. The method according to claim 1, wherein the film element arranged in step b) has one or more dyes and/or one or more adhesives, and in step c) the one or more dyes and/or the one or more adhesives are melted on during application.

4. The method according to claim 1, wherein the film element arranged in step b) has a replication varnish layer, a detachment layer and a transparent protective varnish layer, and wherein a relief structure is molded into the replication varnish layer at least in areas, and wherein the detachment layer is arranged between the replication varnish layer and the transparent protective layer, and wherein the replication varnish layer is facing the thermal print head, and wherein, in step c), the transparent protective varnish layer is applied to the security document, by means of the thermal print head in such a way that a relief structure that is inverted with respect to the relief structure of the replication varnish layer is molded into the transparent protective varnish layer.

5. The method according to claim 1, wherein, in at least one second region, the temperature effect causing the activation of the color change is selected such that, in the at least one second region, the at least one first item of information is not introduced into the thermographic substrate and the one or more first layers of the film element are applied to the security document, for the representation of at least one second item of information by means of the thermal print head.

6. The method according to claim 5, wherein the at least one first region and the at least one second region lie in the maximum recording range of the thermal print head, wherein the maximum recording range corresponds to the maximum area of the thermal print head, with which the thermal print head is in contact with the film element during the introduction of the first item of information in step c).

7. The method according to claim 1, wherein the thermographic substrate provided in step a) is caused to undergo at least two color changes depending on the temperature effect in at least two first regions, wherein the at least two color changes are caused when at least two different temperature limits are exceeded.

8. The method according to claim 1, wherein the thermographic substrate provided in step a), at least in regions, has one or more second layers that are transparent at least in regions, wherein the one or more second layers are arranged between the film element and the thermographic substrate, when observed perpendicular to the plane spanned by the upper side of the thermographic substrate, and wherein, in step c), the temperature effect causing the activation of the color change is transferred through the one or more second layers to the at least one first region of the thermographic substrate.

9. The method according to claim 1, wherein, in step c), the temperature effect is more than 50° C.

10. The method according to claim 1, wherein, in step c), the thermal print head, at least in regions, has a temperature of more than 70° C.

11. The method according to claim 1, wherein the method is carried out by means of a thermal transfer printer.

12. The method according to claim 1, further comprising applying at least one sealing layer to the security document.

13. The method according to claim 12, wherein, the at least one sealing layer is applied by means of cold lamination.

* * * * *